US007507888B2

(12) United States Patent
Rivera et al.

(10) Patent No.: US 7,507,888 B2
(45) Date of Patent: Mar. 24, 2009

(54) FRET AND FINGERBOARD FOR STRINGED INSTRUMENTS

(76) Inventors: Humberto Jason E. Rivera, 5225 Echo Valley St. NW., North Canton, OH (US) 44720; Cheryl J. Rivera, 5225 Echo Valley St. NW., North Canton, OH (US) 44720; Christina R. Rivera, 5225 Echo Valley St. NW., North Canton, OH (US) 44720

( * ) Notice: Subject to any disclaimer, the term of this patent is extended or adjusted under 35 U.S.C. 154(b) by 0 days.

(21) Appl. No.: 12/008,616

(22) Filed: Jan. 11, 2008

(65) Prior Publication Data

US 2009/0056520 A1 Mar. 5, 2009

Related U.S. Application Data

(60) Provisional application No. 60/966,686, filed on Aug. 30, 2007.

(51) Int. Cl.
*G10D 3/06* (2006.01)

(52) U.S. Cl. ..... 84/314 R

(58) Field of Classification Search ..... 84/314 R
See application file for complete search history.

(56) References Cited

U.S. PATENT DOCUMENTS

| | | | | | |
|---|---|---|---|---|---|
| 501,743 | A | * | 7/1893 | Stratton | 84/314 R |
| 967,507 | A | | 8/1910 | Finney | |
| 1,727,620 | A | | 9/1929 | Smith | |
| 2,492,845 | A | * | 12/1949 | Conkling et al. | 84/314 R |
| 2,597,154 | A | | 5/1952 | Maccaferri | |
| 2,664,022 | A | | 12/1953 | Maccaferri | |
| 3,103,846 | A | | 9/1963 | Webster | |
| 3,196,729 | A | | 7/1965 | Burns et al. | |
| 3,273,439 | A | * | 9/1966 | Keefe et al. | 84/314 R |
| 3,712,952 | A | | 1/1973 | Terlinde | |
| 4,064,779 | A | * | 12/1977 | Petillo | 84/314 R |
| 4,221,151 | A | * | 9/1980 | Barth | 84/314 R |
| 4,334,456 | A | | 6/1982 | Martin et al. | |
| 4,620,470 | A | | 11/1986 | Vogt | |
| 4,633,754 | A | | 1/1987 | Chapman | |
| 4,635,518 | A | | 1/1987 | Meno | |

(Continued)

FOREIGN PATENT DOCUMENTS

| | | |
|---|---|---|
| CA | 2 373 218 | 8/2003 |

(Continued)

*Primary Examiner*—Jeffrey Donels
*Assistant Examiner*—Robert W Horn
(74) *Attorney, Agent, or Firm*—Sand & Sebolt

(57) ABSTRACT

A fret and fret board assembly for a stringed instrument provide increased fret stability and serve to increase the duration of fretted notes played on the instrument. Each fret includes a string-engageable cap, a relatively high-mass tang or resonation bar which fits snugly within a mating groove in the fret board and a pair of wings which extend outwardly in opposite directions from the cap and tang and engage the fret board to provide additional stability to the fret and further add to the mass of the fret. The tang preferably has a relatively large outer perimeter so that the interface between the fret board and each of the tang and wings is generally increased. The tang is preferably configured for installation and removal by sliding the fret lengthwise in and out of the groove. The fret board may include reinforcing rods.

20 Claims, 14 Drawing Sheets

U.S. PATENT DOCUMENTS

| | | | | |
|---|---|---|---|---|
| 4,723,469 | A * | 2/1988 | Vogt | 84/314 R |
| 4,981,064 | A | 1/1991 | Vogt | |
| 5,072,643 | A | 12/1991 | Murata | |
| 5,133,239 | A | 7/1992 | Rudolph | |
| 5,760,322 | A | 6/1998 | Ward et al. | |
| D401,266 | S | 11/1998 | Lojacono | |
| 5,952,593 | A * | 9/1999 | Wilder | 84/314 R |
| 6,252,149 | B1 | 6/2001 | Matsushita | |
| 6,369,306 | B2 * | 4/2002 | Chapman | 84/314 R |
| 6,613,969 | B1 * | 9/2003 | Petillo et al. | 84/314 R |
| 7,256,336 | B2 | 8/2007 | Muncy et al. | |
| 2001/0029827 | A1 | 10/2001 | Chapman | |
| 2004/0173080 | A1 | 9/2004 | Pye et al. | |

FOREIGN PATENT DOCUMENTS

| | | | |
|---|---|---|---|
| CA | 02506440 | | 5/2005 |
| DE | 3413765 | | 10/1985 |
| DE | 3413765 | A1 * | 10/1985 |
| DE | 102005038852 | | 2/2007 |
| JP | 02-073295 | | 3/1990 |
| JP | 03-189696 | | 8/1991 |
| JP | 09-26784 | | 1/1997 |
| JP | 2002-41029 | | 2/2002 |
| JP | 2003-033801 | | 2/2003 |
| JP | 2004-317826 | | 11/2004 |
| JP | 2007041608 | | 2/2007 |

* cited by examiner

FRET AND FINGERBOARD FOR STRINGED INSTRUMENTS

CROSS REFERENCE TO RELATED APPLICATIONS

This application claims priority from U.S. Provisional Application Ser. No. 60/966,686 filed Aug. 30, 2007; the disclosure of which is incorporated herein by reference.

BACKGROUND OF THE INVENTION

1. Technical Field

The present invention is related generally to stringed instruments and particularly stringed instruments which use frets. More particularly, the invention is related to the frets used with such stringed instruments and the fingerboard or fret board on which the frets are mounted.

2. Background Information

Stringed instruments which utilize frets mounted on the neck of the instrument to facilitate changing the pitch during the fingering of the instrument are well known in the art. Many different types of frets have been proposed to address one problem or another in the art, and include frets which have removable portions, frets which are retractable into the neck or fret board and frets which are curved or otherwise configured to extend along the surface of the fret board other than at right angles to the length of the neck. Some frets have relatively pointed upper surfaces which are contacted by the strings when a player depresses the string while others have rounded or flat upper surfaces.

Some of the prior art includes U.S. Pat. No. 4,064,779 granted to Petillo and U.S. Pat. No. 6,613,969 granted to Petillo et al., each of which discloses frets having rather sharp tips. U.S. Pat. No. 3,712,952 granted to Terlinde teaches a generally cylindrical groove and cylindrical nylon fret having metallic inserts with electrical leads connected to the inserts. U.S. Pat. No. 2,492,845 granted to Conkling et al. disclosed a flexible spring fret which is used in conjunction with a compressible rubber or rubber like fret board in which the fret includes a depressor plate which the guitarist depresses into the compressible fret board in order to move the fret proper to produce a vibrato effect. U.S. Patent Application Publication 2001/0029827 of Chapman discloses several prior art configurations and a generally square bar with a pair of its corners aligned horizontally and with various portions removed to produce various cross sectional shapes in which a portion of the bar extends above the upper surface of the fret board. Chapman further discloses adhesive retaining slots used to secure the fret to the fret board. U.S. Pat. No. 4,723,469 granted to Vogt discloses a fret which utilizes a metal body and has an upwardly opening groove in which a plastic insert is removably inserted and serves as the fret proper. U.S. Pat. No. 3,273,439 granted to Keefe et al. and U.S. Pat. No. 5,952,593 granted to Wilder both disclose channel members which are secured within the grooves of a fret board and themselves include grooves which slidably receive a fret in its lengthwise direction for mounting the fret on the fret board. Keefe further discloses a metal or plastic fret board with grooves into which respective frets are slid lengthwise for mounting on the fret board in order to eliminate the use of a wooden fret board and any potential damage to such a wooden fret board. Thus, the frets in these two patents do not disclose a sliding insertion of a fret which is in direct contact with a wooden fret board. U.S. Pat. No. 4,221,151 granted to Barth discloses a hollow circular fret which is held in place by a screw which threadably engages the bottom portion of the side wall of the fret in order to provide a stable mounting of the fret. Barth specifically discusses the inadequacy of the structural stability and removability of frets such as disclosed in the Keefe patent noted above.

While frets obviously have a variety of configurations, the Applicants are not aware of any frets which specifically address the need to create a fret which increases the sustain or endurance of a given note compared to the frets known in the art. The frets and fret board of the present invention address this and other problems in the art.

BRIEF SUMMARY OF THE INVENTION

The present invention provides a fret for a stringed instrument comprising: a cap having a string-engageable top and a bottom; a tang having a top and a bottom and adapted to fit within a groove in a fret board; a first wing having a top permanently secured to the bottom of the cap and a bottom permanently secured to the top of the tang; the first wing extending laterally outward from the bottom of the cap and the top of the tang in a first direction to a first terminal edge; and a second wing having a top permanently secured to the bottom of the cap and a bottom permanently secured to the top of the tang; the second wing extending laterally outward from the bottom of the cap and the top of the tang in a second direction opposite the first direction to a second terminal edge; the bottoms of the first and second wings adapted to abut an upwardly facing surface of the fret board when the tang is in the groove.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
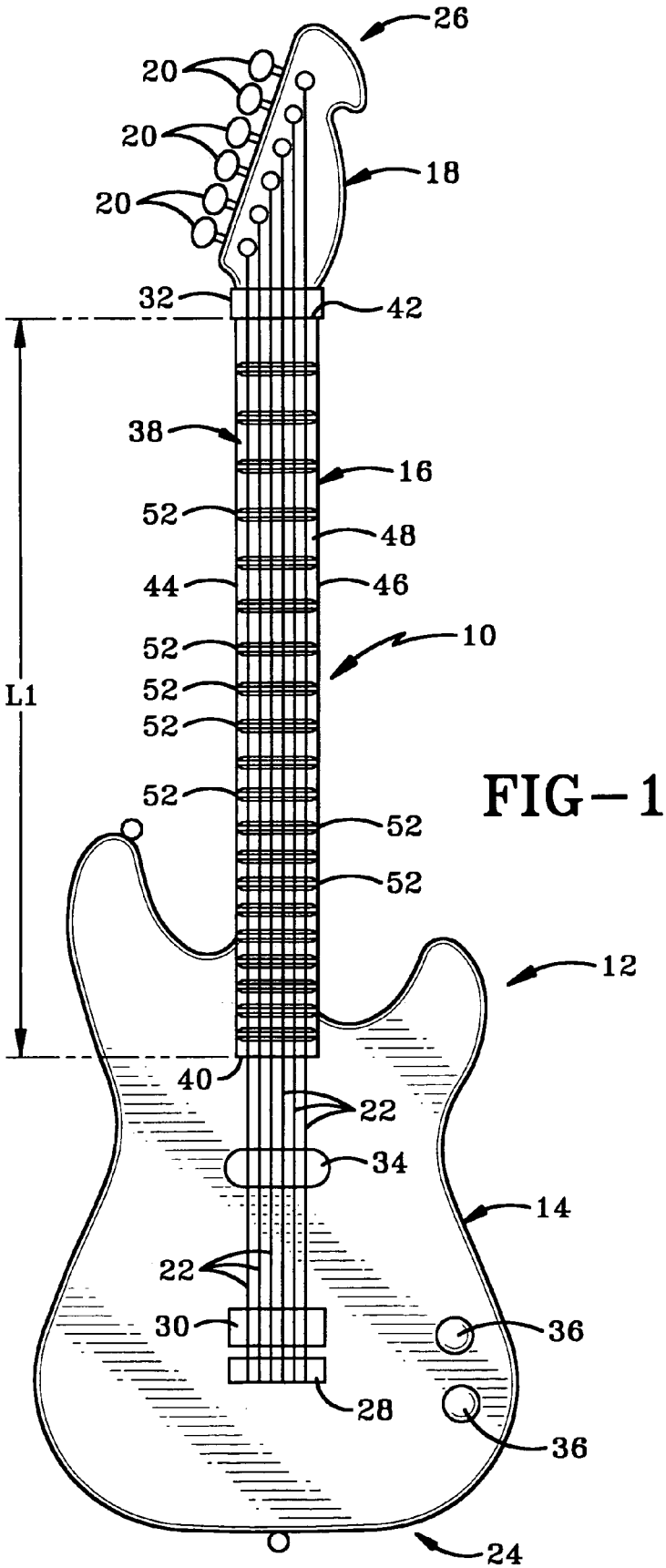
FIG. 1 is a top plan view of an electric guitar utilizing a first embodiment of the fret and fret board assembly of the present invention.
Figure 10:
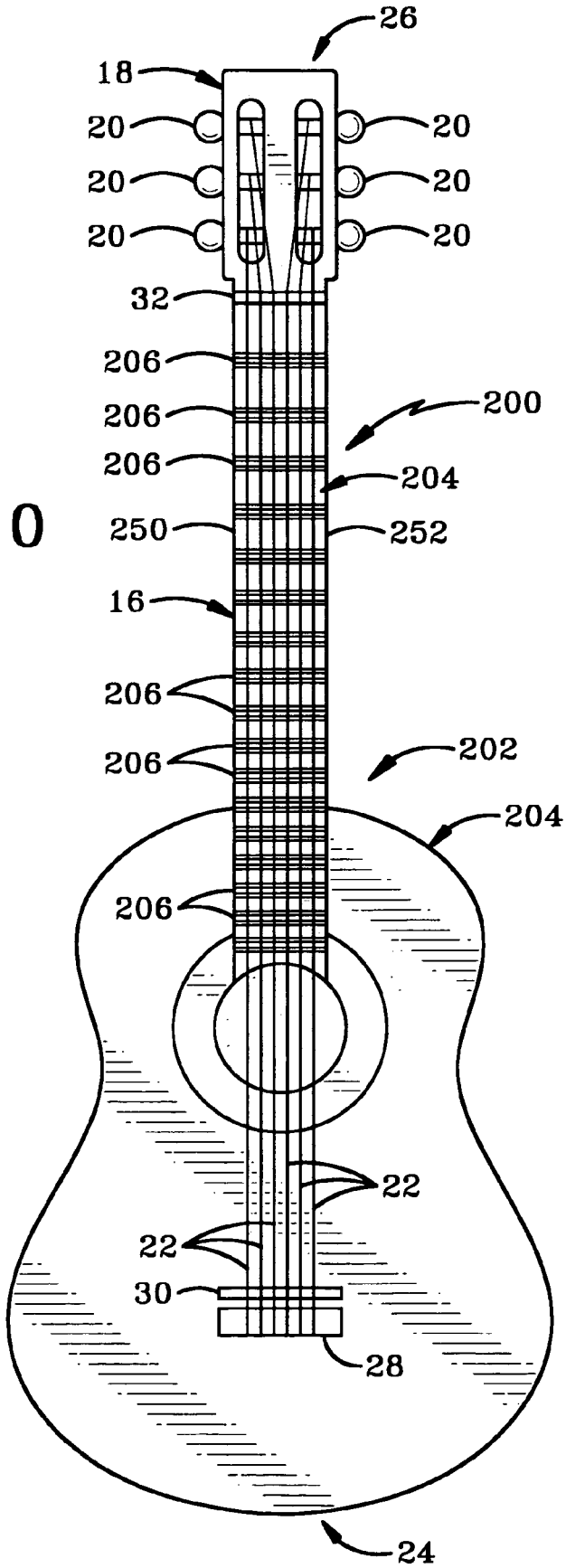
FIG. 10 is a top plan view of an acoustic guitar utilizing a second embodiment of the fret and fingerboard assembly of the present invention.
Figure 17:
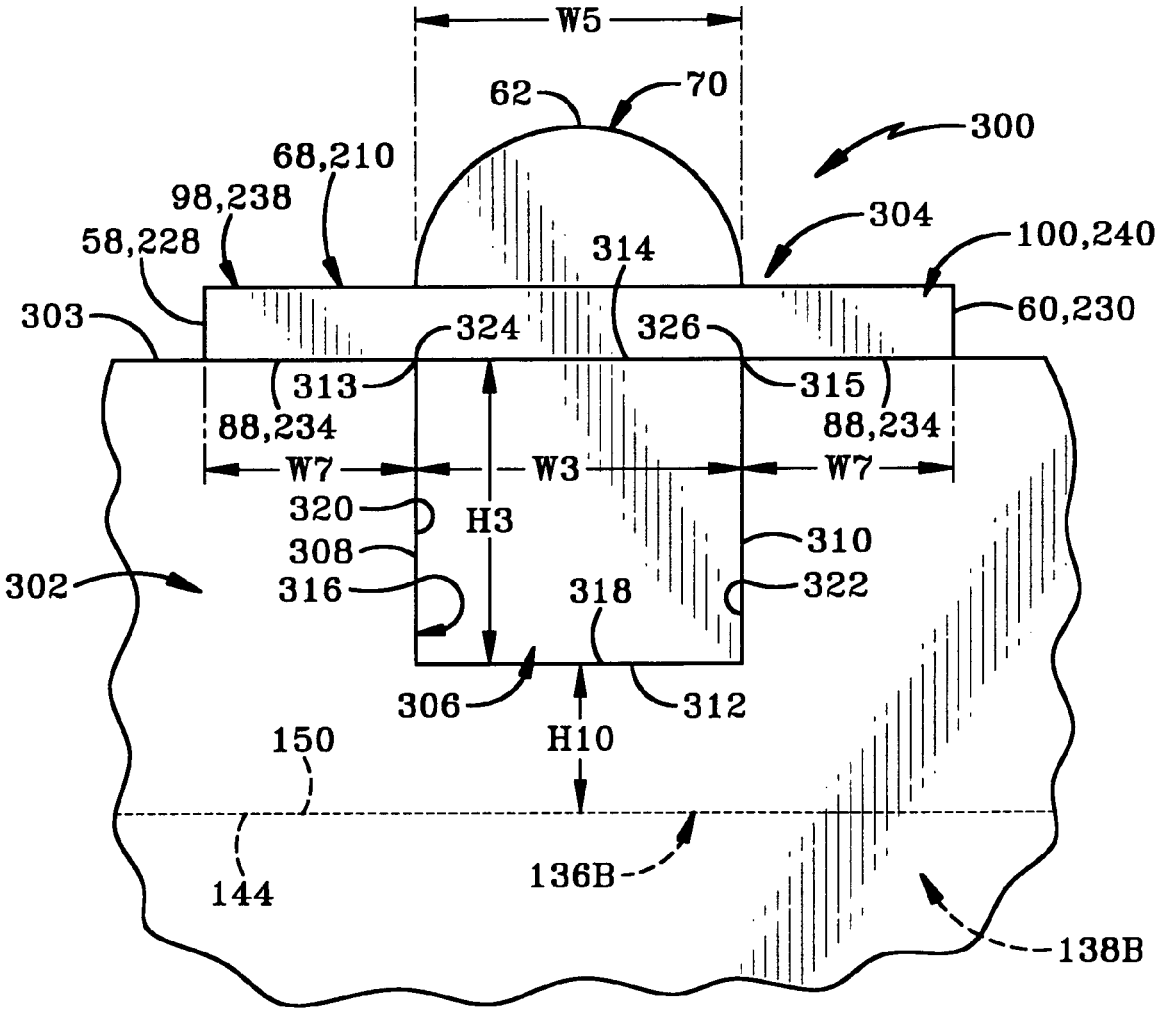
FIG. 17 is an end elevational view similar to FIG. 16 showing a third embodiment of the fret and fingerboard of the present invention.

A first embodiment of the fret and fret board assembly of the present invention is shown generally at 10 in FIG. 1; a second embodiment of the fret and fret board of the present invention is shown generally at 200 in FIG. 10; and a third embodiment of the fret and fret board assembly of the present invention is shown generally at 300 in FIG. 17. Referring to FIG. 1, the frets and fret board 10 of the present invention are mounted on a fretted stringed instrument in the form of an electric guitar 12 having a generally solid body 14 and a neck 16 extending outwardly therefrom and terminating in a head 18 on which tuning pegs 20 are rotatably mounted for tuning respective strings 22. Guitar 12 has a first end 24 defined by a body 14 and a second opposed end 26 defined by head 18. First and second ends 24 and 26 define therebetween a longitudinal direction of guitar 12. Thus, neck 16 is elongated in the longitudinal direction. A string-mounting board or block 28 is mounted on body 14 for securing strings 22 to body 14. A bridge 30 is disposed adjacent block 28 and a nut 32 is secured to neck 16 adjacent its intersection with head 18. Bridge 30 and nut 32 extend outwardly from the neck and body and engage strings 22 to support strings 22 in a position spaced a short distance above frets and fret board 10. An electromagnetic pickup 34 is mounted on body 14 adjacent bridge 30 and control knobs 36 are also mounted on body 14 for respectively controlling the volume or the like. The frets and fret board of the present invention are shown in use with electric guitar 12, but are broadly useful with any stringed instruments which utilizes frets, for example banjos, ukuleles, mandolins, bass guitars, bouzoukis, fretted violins and so forth.

In accordance with the invention, assembly 10 includes a finger board or fret board 38 having a first end 40 mounted on body 14 and a second opposed end 42 mounted on neck 16 and abutting nut 32. First and second ends 40 and 42 define therebetween a longitudinal direction of fret board 38 and a length L1 thereof. While length L1 can vary substantially especially given the various stringed instruments to which the invention is applicable, a common neck length for a standard electric guitar is somewhere on the order of about 25 inches. Fret board 38 has first and second sides or edges 44 and 46 defining therebetween an axial direction and a width W1 (FIG. 6) of fret board 38. Width W1 may also vary substantially but typically is within the range of 1½-3 inches and more commonly from about 1¾-2½ inches. Fret board 38 has an upper surface 48 and lower surface 50 (FIG. 6) defining therebetween a thickness or height H1. Height H1 may also vary but is typically approximately ¼ to 5/16 inch. Fret board 38 is typically formed of a hardwood which includes but is not limited to ebony, maple and rosewood. Assembly 10 further includes a plurality of axially extending parallel frets 52 which are longitudinally spaced from one another at intervals according to a mathematical formula well known in the art. Each fret 52 extends from first side 44 to second side 46 of fret board 38.

Figures 2, 3:
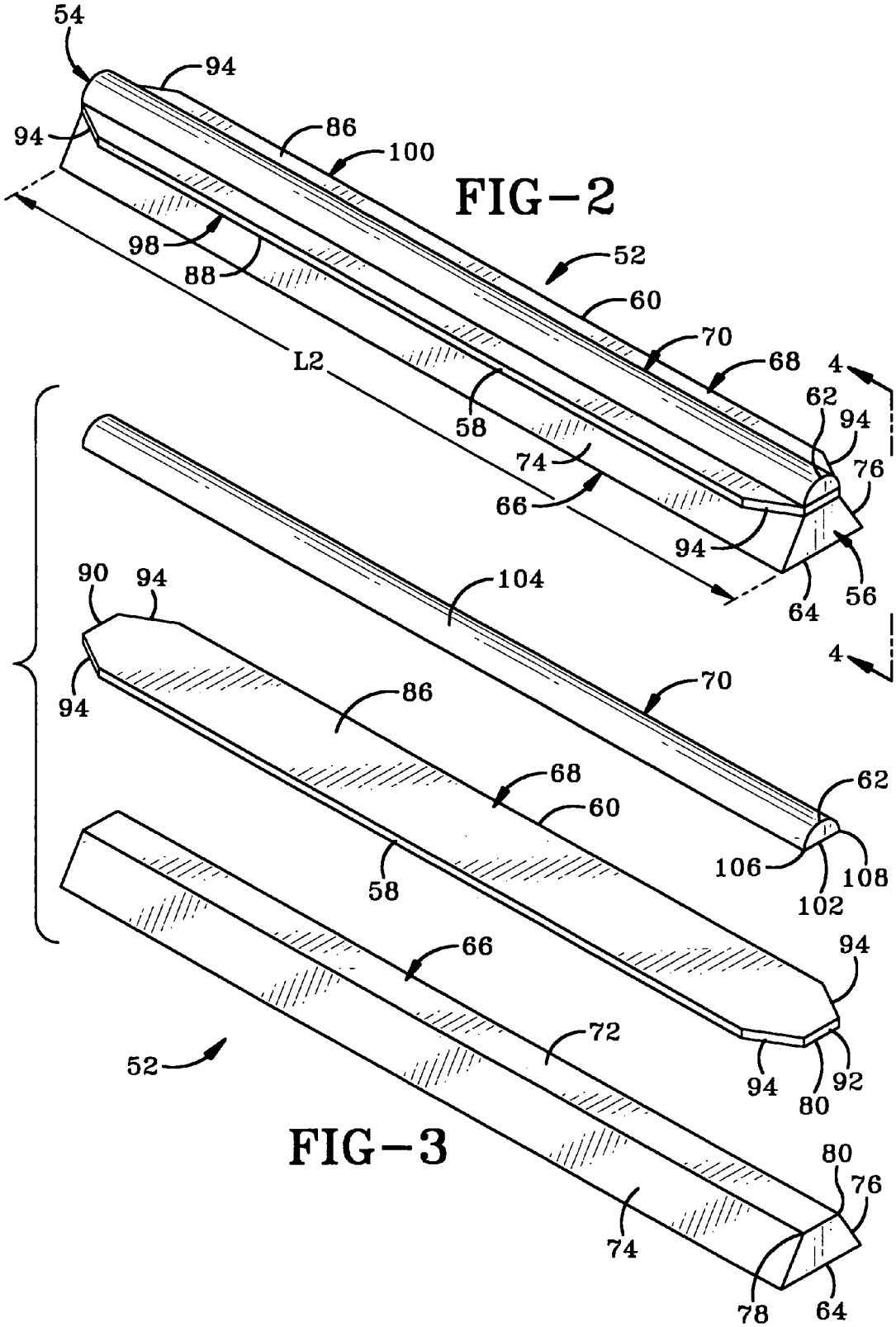
FIG. 2 is an enlarged perspective view of the first embodiment of the fret of the present invention.
FIG. 3 is an exploded perspective view of the fret of the first embodiment.
Figure 4:
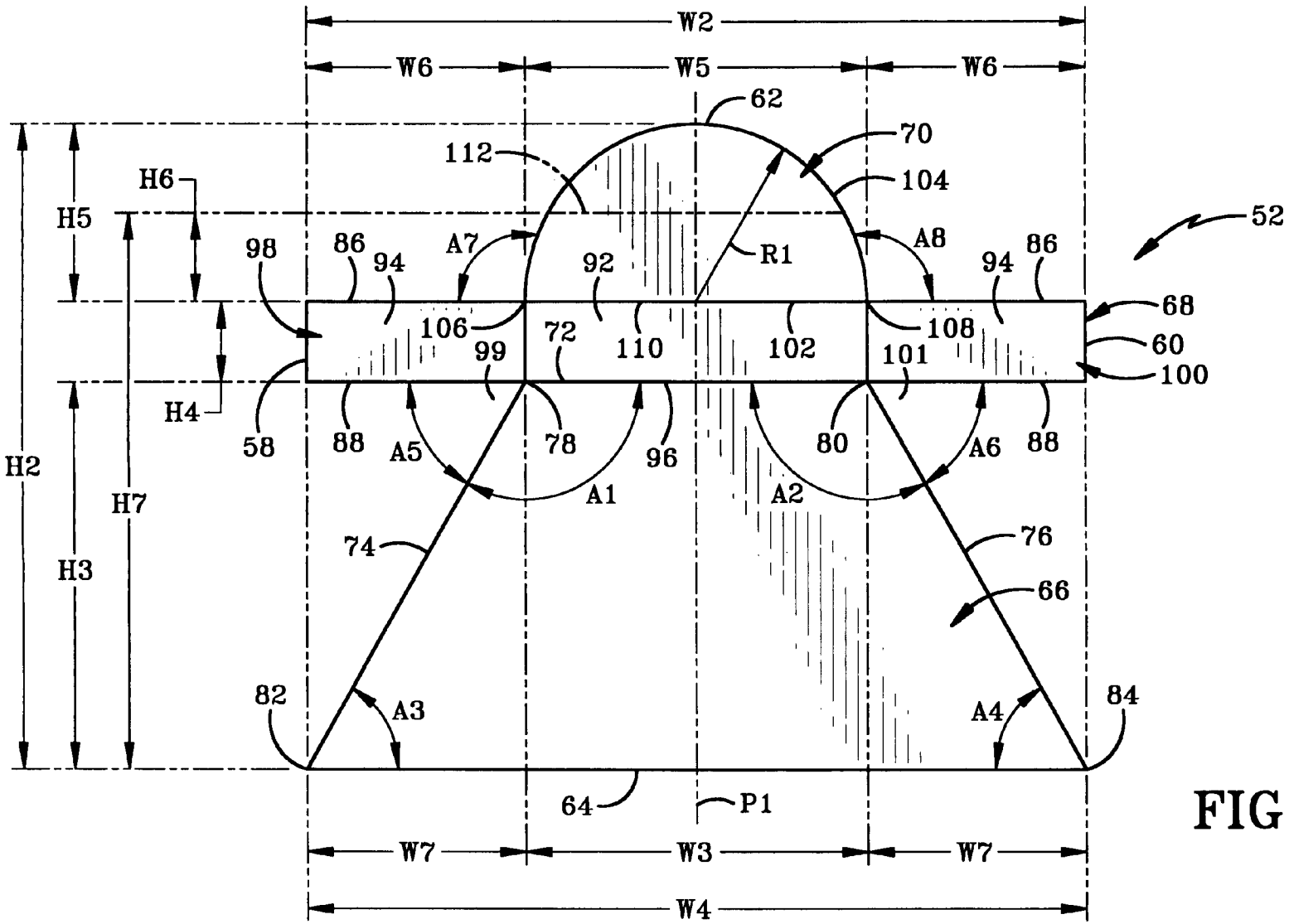
FIG. 4 is an end elevational view taken on line 4-4 of FIG. 2.

Referring to FIGS. 2-4, fret 52 is described in greater detail. Fret 52 has first and second ends 54 and 56 which define therebetween a longitudinal direction of fret 52 and a length L2 (FIG. 2) thereof. Fret 52 has first and second opposed sides 58 and 60 defining therebetween a width W2. Fret 52 further has a top 62 and bottom 64 defining therebetween a height H2. Length L2 is substantially the same as width W1 of fret board 38 at the position in which fret 52 is installed on fret board 38. Thus, the frets 52 on a tapered fret board 38 will vary in length depending on their location while a fret board having a constant width will result in the use of frets 52 which are all the same length. Width W2 in the exemplary embodiment is approximately 0.25 inch (¼ inch) and typically ranges from about 0.20 up to about 0.312 inch (5/16 inch) or to 0.375 inch (⅜ inch) and may in some cases be up to 9/16 or ½ inch. Height H2 in the exemplary embodiment is approximately 0.205 inch and typically ranges from about 0.188 inch (3/16 inch) to about 0.335 inch or greater in certain circumstances.

Fret 52 includes a resonation bar or tang 66, a plate 68 permanently or non-removably secured to the top of tang 66 and a string-engaging cap 70 which is permanently or non-removably secured to the top of plate 68. Each of tang 66, plate 68 and cap 70 extend from first end 54 to second end 56 of fret 52. Fret 52 and the other frets described hereinafter are solid members which are typically formed of metal. Due to the fact that fret 52 is formed of three major components, each of these components may be of the same or different metals. In the exemplary embodiment, tang 66 and plate 68 are formed of brass while cap 70 is formed of a nickel and silver alloy which is commonly known in the art. However, the entire fret or any of its components may by formed of various metals, including but not limited to stainless steel alloys, nickel alloys, titanium alloys, molybdenum alloys and so forth.

Tang 66 has a dovetail configuration and in the exemplary embodiment has a cross section with the shape of a trapezoid which is bilaterally symmetrical with respect to a vertical plane P1 which extends along the length of tang 66. In the exemplary embodiment, fret 52 is in its entirety bilaterally symmetrical about plane P1, and thus each of plates 68 and cap 70 are bilaterally symmetrical about plane P1. Tang 66 has a flat horizontal bottom which serves as bottom 64 of fret 52. Tang 66 also has horizontal flat top 72 so that top 72 and bottom 64 define therebetween a height H3 which in the exemplary embodiment is approximately 0.125 inch (⅛ inch). Height H3 typically falls within the range of 0.063 to 0.19 inch (1/16 to about 3/16 inch). Since it is usually desired to maintain fret board 38 in a single unit, height H3 typically is not greater than 0.19 inch based on the height H1 of fret board 38 noted above although height H3 may exceed this measurement under certain circumstances. Tang 66 also has first and second flat sides 74 and 76 which taper downwardly and outwardly from top 72 to bottom 64. First side 74 meets top 72 at an intersection or obtuse corner 78 while second side 76 meets top 72 at another intersection or obtuse corner 80. Thus, top 72 and first side 74 define therebetween an angle A1 which in the exemplary embodiment is approximately 120 degrees while top 72 and second side 76 defines therebetween an angle A2 which in the exemplary embodiment is also approximately 120 degrees. More broadly, angles A1 and A2 typically fall within the range of about 95 to 150 degrees and typically from about 135 or 140 degrees to about 100 to 105 degrees. First side 74 meets bottom 64 at an intersection or acute corner 82 while second side 76 meets bottom 64 at another intersection or acute corner 84. Thus, first side 74 and bottom 64 define therebetween and angle A3 which in the exemplary embodiment is approximately 60 degrees while second side 76 and bottom 64 define therebetween and acute angle A4 which in the exemplary embodiment is also approximately 60 degrees. Obtuse corners 78 and 80 define therebetween a width W3 which in the exemplary embodiment is approximately 0.11 inch and is typically within the range of 0.08 to 0.14 inch and more broadly from about 1/16 or 3/32 to about 3/16 or 1/4 inch. Acute corners 82 and 84 define therebetween a maximum width W4 of tang 66 which is wider than width W3 and in the exemplary embodiment is substantially the same as width W2 and thus approximately 0.25 inch (1/4 inch). Width W4 typically ranges from about 0.20 to 0.312 inch (5/16 inch) or 0.375 inch (3/8 inch) and may be up to 9/16 or 1/2 inch in certain circumstances.

Plate 68 has a substantially flat horizontal top 86 and a flat horizontal bottom 88 which extend from a first end 90 to a second end 92 of plate 66 which are coincident with first and second ends 54 and 56 of fret 52. Sides 58 and 60 of fret 52 also serve as the sides or edges of plate 66 which define its maximum width W2. Plate 68 also has tapered corners or edges 94 which are typically straight and extend from one of ends 90 and 92 to one of sides or edges 58 or 60 adjacent the respective edge 90 or 92. Corners 94 may also be rounded instead of being straight. In either case, corners 94 are configured to eliminate or minimize sharp corners or edges which might cause injury to the hand of a guitarist during play. The central portion of bottom surface 88 is non-removably secured to top 72 of tang 66 such as by solder 96. Plate 68 thus forms first and second wings 98 and 100 which respectively extend laterally outwardly in opposite directions from top 72 at corners 78 and 80. Bottoms 88 of wings 98 and 100 are typically coplanar. Likewise, tops 86 of wings 98 and 100 are typically coplanar and parallel to bottoms 88. Bottom 88 of first wing 98 and first side 74 of tang 66 thus form therebetween an angle A5 which in the exemplary embodiment is approximately 60 degrees. Likewise, bottom 88 of second wing 100 and second side 76 of tang 66 define therebetween an angle A6 which in the exemplary embodiment is approximately 60 degrees. Typically, angle A5 and A6 are in the range of about 30 to 85 degrees and more typically from about 40 or 45 degrees to about 75 or 80 degrees. Side 74 and bottom 88 of wing 98 define therebetween a triangular space 99. Likewise, side 76 and bottom 88 of wing 100 define therebetween a triangular space 101. Top 86 and bottom 88 define therebetween a thickness or height H4 of plate 66 and wings 98 and 100 which in the exemplary embodiment is approximately 0.025 inch. Height H4 typically ranges from about 0.020 to 0.060 inch.

Cap 62 has a semicircular cross section with a flat horizontal bottom 102 and a semicircular upwardly facing surface 104 which extends upwardly from bottom 102 and intersects bottom 102 at first and second edges or corners 106 and 108. Semicircular surface 104 has a peak which serves as the top of cap 70 as well as fret 52 and is thus synonymous with top 62. Peak 62 and bottom 102 define therebetween a height H5 which is the same as radius R1 of the semicircular cap 70 and which in the exemplary embodiment is approximately 0.055 inch. Height H5 and radius R1 typically range from about 0.025 to 0.085 inch. Bottom 102 is non-removably secured to a central portion of top 86 of plate 68 such as by solder 110. Edges or corners 106 and 108 define therebetween a maximum width W5 of cap 70 which in the exemplary embodiment is approximately 0.11 inch and thus in the exemplary embodiment is approximately the same as width W3. However, width W5 may be less than or greater than width W3 and in keeping with the semicircular shape of cap 70 is approximately twice that of radius R1 and height H5, thus falling typically within the range of about 0.05 to 0.17 inch. Top 86 of first wing 98 and surface 104 at edge 106 (or a tangent thereto) define therebetween an angle A7 which in the exemplary embodiment is approximately 90 degrees and typically is somewhere in the range of about 90-120 degrees. Likewise, top 86 of wing 100 and surface 104 adjacent edge 108 (or a tangent thereto) define therebetween an angle A8 which is typically about 90 degrees or within the same ranges as angle A7.

FIG. 4 also represents that cap 70 may be ground down or otherwise configured to have an alternate generally flat horizontal top 112 shown in dashed lines which gives the cap a generally rectangular cross section. Top 112 would thus serve as the string contact surface instead of top 62 or a portion of surface 104 adjacent top 62. When cap 70 is configured with alternate top 112, bottom 102 and top 112 define therebetween a height H6 typically in the range of about 0.025 to 0.055 inch. Thus, when cap 70 has an alternate top 112, top 112 and bottom 64 define therebetween a height H7 of the alternate fret 52 which in the exemplary embodiment is approximately 0.175 inch. Height H7 typically falls within about the same ranges as height H2.

With continued reference to FIG. 4, wing 98 thus extends laterally and horizontally outwardly beyond each of edge 106 and corner 78 to terminal edge 58 a distance or width W6 which in the exemplary embodiment is about 0.07 inch. Second wing 100 extends in the same manner relative to edge 108 and corner 80 to terminal edge 60 and is thus likewise indicated by distance or width W6. Width W6 typically falls within the range of about 0.04 to 0.10 inch and more broadly about 0.30 to 0.23 inch. FIG. 4 also shows that acute corner 82 is disposed outwardly beyond edge 106 and corner 78 a distance or width W7 which in the exemplary embodiment is approximately 0.07 inch as measured in the horizontal direction. Likewise, acute corner 84 is disposed outwardly in the other direction beyond edge 108 and corner 80 a distance or width which is likewise represented by W7 as measured in the horizontal direction. Width W7 typically falls within the range of about 0.40 to 0.10 inch and more broadly about 0.03 to 0.23 inch.

Figure 5:
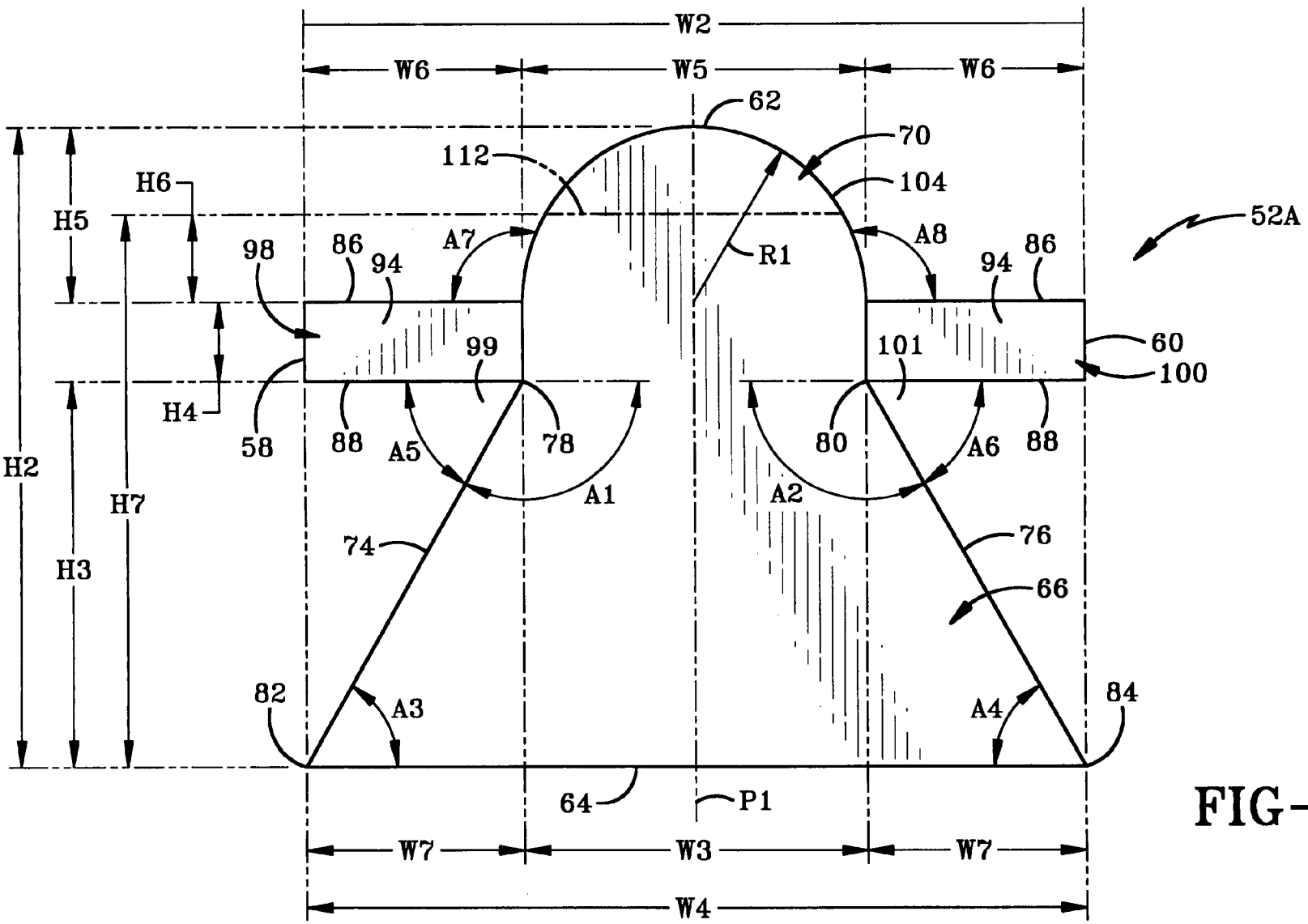
FIG. 5 is an end view similar to FIG. 4 showing and alternate one piece fret of the first embodiment.

FIG. 5 illustrates fret 52A which is substantially the same as fret 52 except that it is formed of a single piece of metal instead of in three components which are soldered together. Typically, fret 52A is formed by extrusion although other methods may be suitable. As can be seen easily from the various markings of FIG. 5, fret 52A has the same dimensions and ranges thereof as discussed with regard to fret 52 except that wings 98 and 100 are formed without the specific use of a plate such as plate 68 of fret 52.

Figure 6:
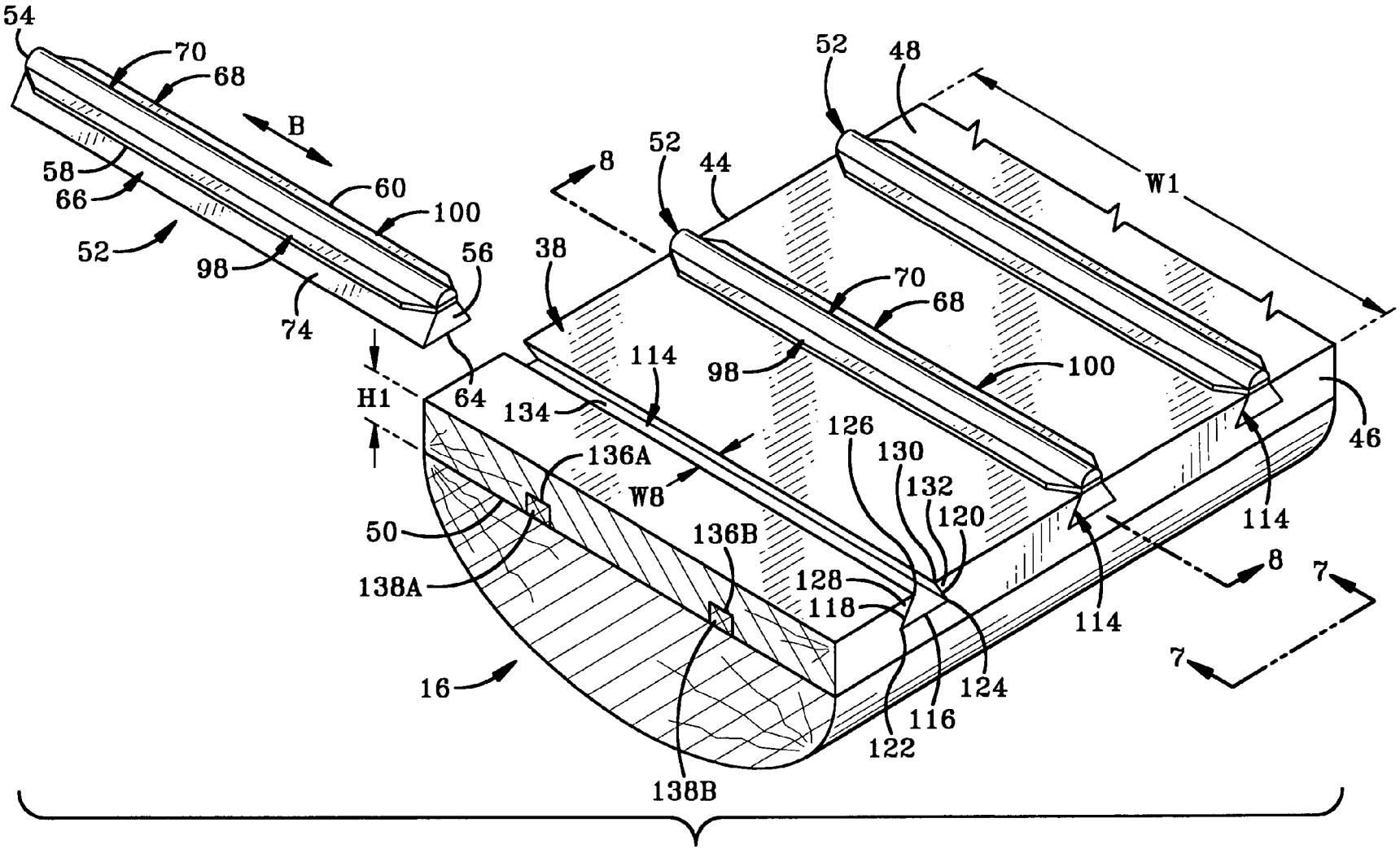
FIG. 6 is a perspective view of the assembly of the first embodiment with portions cut away and portions of the fret board shown in section and secured to the neck of the guitar with one of the frets removed from its groove in the fret board.
Figure 7:
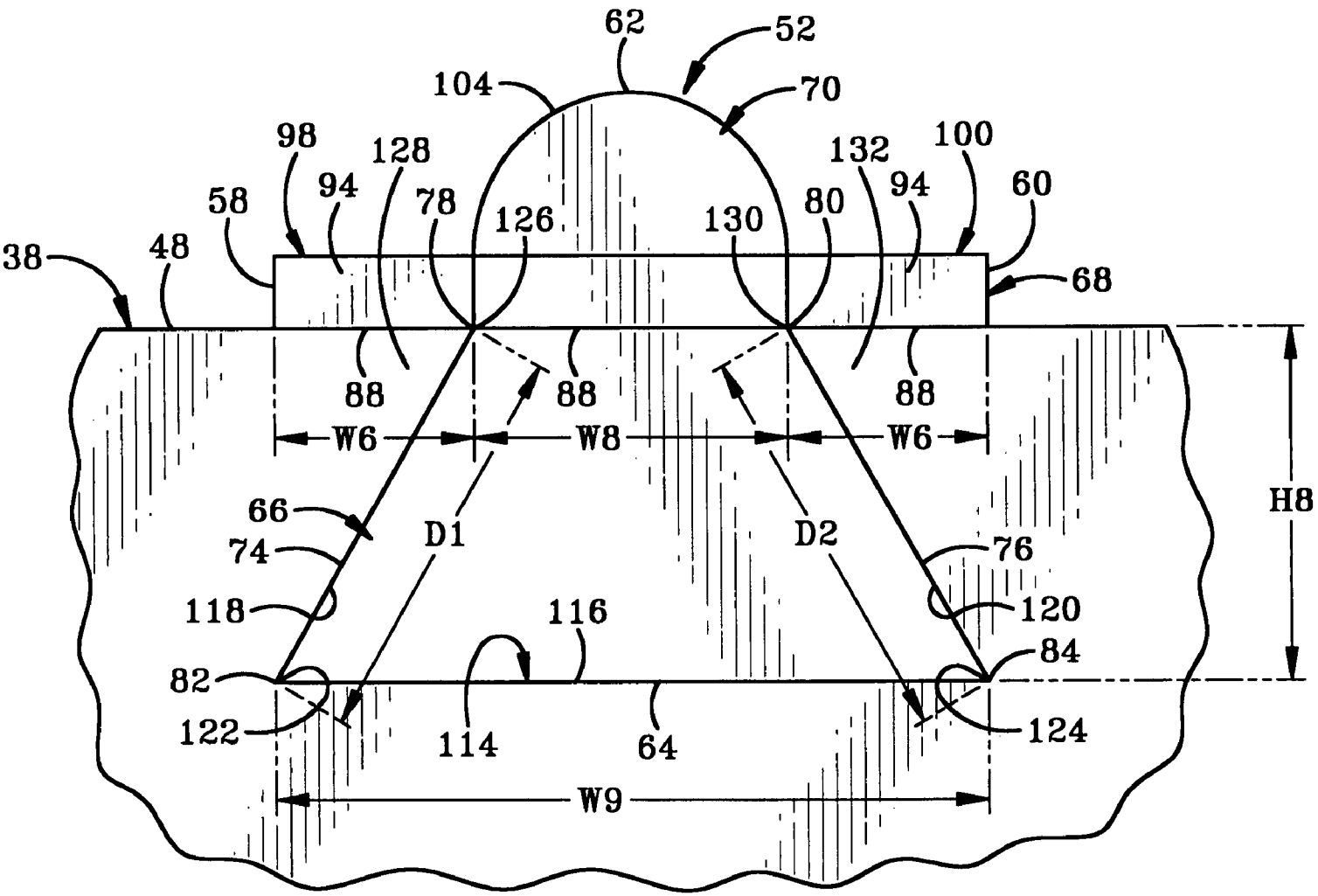
FIG. 7 is an enlarged end elevational view taken on line 7-7 of FIG. 6.

Tang 66 has an exposed outer surface or perimeter (other than at its ends) which includes bottom 64 and first and second angled sides 74 and 76, all of which extend the entire length of tang 66. In the exemplary embodiment, this outer perimeter of tang 66 as measured perpendicular to the length of fret 52 is about 0.536 inch. This outer perimeter typically ranges from about 0.139 to about 1.10 inch. This outer perimeter or exposed outer surface of tang 66 comprising bottom 64 and sides 74 and 76 is intended to be substantially in full continuous contact with fret board 38 when installed thereon (FIGS. 6-7). The trapezoidal cross section of tang 66 is substantially constant from end to end along its length to facilitate the lengthwise sliding installation and removal of tang 66 (Arrow B in FIG. 6) into and out of one of a plurality of parallel grooves 114 formed in fret board 38.

Each groove 114 extends from first side 44 to second side 46 of fret board 38 and extends downwardly from upper surface 48 so that each groove 114 opens upwardly. Each groove 114 has a mating configuration with tang 66 and thus has a trapezoidal cross sectional configuration which is only slightly larger than that of tang 66, typically within tolerance range of about 0.001 to 0.005 and more preferably about 0.001 to 0.002 inch larger in any given direction. Each groove 114 is bounded by a flat horizontal bottom 116 and first and second sides 118 and 120 which taper upwardly and inwardly from bottom 116 toward one another to upper surface 48. First side 118 intersects bottom 116 at and intersection or acute corner 122 so that side 118 and bottom 116 define therebetween an angle which is substantially the same as angle A3 (FIG. 4). Likewise, second side 120 and bottom 116 meet at an intersection or acute corner 124 so that side 120 and bottom 116 define therebetween an angle which is substantially the same as angle A4 (FIG. 4). First side 118 meets upper surface 48 at an intersection or acute corner 126 to define a first overhang 128 which overhangs a portion of groove 114. Likewise, second side 120 meets upper surface 48 at an intersection or acute corner 130 to define a second overhang 132 which also overhangs a portion of groove 114. First side 74 and upper surface 48 define therebetween an angle substantially the same as angle A5 (FIG. 4). Likewise, second side 76 and upper surface 48 define therebetween an angle substantially the same as angle A6 (FIG. 4).

Corners 126 and 130 define therebetween a gap or entrance opening 134 having a width W8 at the top of groove 114 which is at the level of upper surface 48. Width W8 is thus only slightly larger than width W3, typically by the above-noted tolerance range. Bottom 116 of groove 114 has a width W9 defined between corners 122 and 124 which is only slightly larger than width W4 and typically within the same tolerance range. Upper surface 48 and bottom 116 define therebetween a vertical height H8 which is only slightly larger than height H3 of tang 66 and typically within the same tolerance range. Corners 122 and 126 define therebetween a length or distance D1 of side 118 as measured perpendicular to the length of groove 114 which is only slightly larger within the same tolerance range than that of the corresponding distance defined between corners 82 and 78 of side 74 of tang 66. Likewise, corners 124 and 130 define therebetween a length or distance D2 measured in the same manner as side 120 which is only slightly larger although within the same tolerance range than the corresponding length of side 76 of tang 66 defined between corners 84 and 80. Distances D1 and D2 vary depending on the size of angles A1-A4 and are thus not specified.

When fret 52 is mounted on fret board 38 by sliding tang 66 lengthwise into groove 114, a very snug fit is produced which prevents tang 66 from sliding lengthwise out of groove 114 absent an intentional force applied to one of ends 54 and 56 for that purpose. Overhangs 128 and 130 fit respectively within spaces 99 and 101 (FIG. 4) to prevent tang 66 from being removed upwardly from groove 114. In the most preferred embodiment, fret 52 is secured only by this frictional engagement and interference and thus no glue or other adhesive is used to secure fret 52 to fret board 38. It is also preferable that assembly 10 is free of screws or other fasteners extending from fret board 38 to frets 52 which would prevent the lengthwise sliding of frets 52 within their respective grooves 114 or otherwise engage frets 52. In the preferred embodiment, only the frictional engagement between the fret and fret board prevents the lengthwise sliding of frets 52. The close tolerances noted above ensure that a substantially continuous contact is made between first side 74 of tang 66 and first side 118 bound in groove 114 from corner 82 to corner 78 and from first end 54 to second end 56. The same type of substantially continuous engagement or contact is formed between second side 76 and second side 120. Likewise, a substantially continuous contact is maintained between bottom 64 of tang 66 and bottom 116 bound in groove 114 all along the length thereof and the width between corners 82 and 84 and corners 122 and 124. Thus, frets 52 are primarily intended to be in direct contact with the wooden fret board as opposed to being slidably received within channel members such as disclosed in the Keefe and Wilder patents discussed in the Background section of the present application.

Although the non-circular dovetail configuration of tang 66 and the close tolerance fit of tang 66 within groove 114 provide substantial stability to fret 52 to substantially minimize the movement of fret 52 relative to fret board 38, wings 98 and 100 substantially increase that stability in that bottoms 88 thereof also maintain a substantially continuous contact with upper surface 48 adjacent groove 114 over the entire area defined by bottoms 88 of wings 98 and 100. Thus, this contact is maintained substantially from corner 78 outwardly to terminal end or edge 58 (width W7) as well as from corner 80 outwardly to terminal edge 60 (width W7) along the length of wings 98 and 100 between beveled corners 94. Thus, the total contact interface or distance as measured perpendicular to the length of fret 52 may be represented as the outer perimeter of tang 66 discussed above plus two times width W7 which thus represents the bottoms 88 of wings 98 and 100. In the exemplary embodiment, this distance is about 0.676 inch and will typically range from about 0.400 to 1.555 inch. The portions of bottoms 88 adjacent corners 94 also maintains a substantially continuous contact with upper surface 48. The configuration of tang 66 and wings 98 and 100 in conjunction with groove 144 thus provides substantial stability to fret 52 to prevent it from rocking about an axis extending along the length of fret 52 relative to fret board 38. This additional stability provided by the interface between fret board 38 and wings 98 and 100 adds to the ability of frets 52 to maintain superior stability despite expansion and contraction of the hardwood of the fret board which occurs with humidity changes and the gradual drying of the wood over time.

In addition to the contact area between fret 52 and fret board 38, fret 52 has a relatively substantial mass which may be represented indirectly by the cross sectional area taken perpendicular to the length of fret 52. This total cross sectional area would thus include the cross sectional areas of tang 66, plate 68 and cap 70. In the exemplary embodiment, this total cross sectional area is about 0.034 square inch and typically falls within the range of 0.012 to 0.132 square inch. This cross sectional area may be broken down into the cross sectional areas of the various components. For instance, the cross sectional area of tang 66 in the exemplary embodiment is about 0.023 square inch and typically falls within the range of 0.007 to 0.091 square inch. The cross sectional area of plate 68 in the exemplary embodiment is about 0.006 square inch and typically ranges from 0.004 to 0.03 square inch. The cross sectional area of each wing 98, 100 in the exemplary embodiment is about 0.002 square inch and typically ranges from about 0.001 to 0.014 square inch. The cross sectional area of cap 70 in the exemplary embodiment is about 0.005 square inch and typically ranges from 0.001 to 0.011 square inch. Thus, the cross sectional area above top 72 of tang 66 is in the exemplary embodiment about 0.011 square inch and typically falls within the range of 0.005 to 0.041 square inch.

Figure 8A:
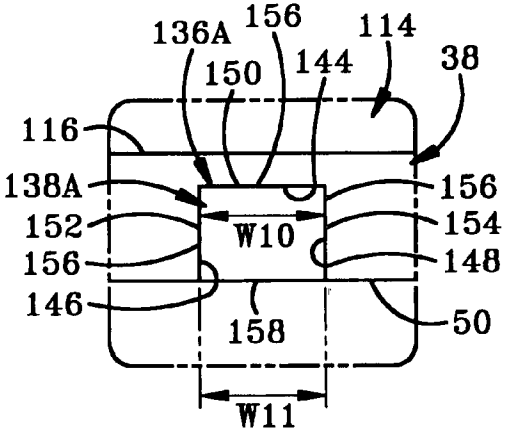
FIG. 8A is an enlarged view of the encircled portion of FIG. 8.
Figure 8:
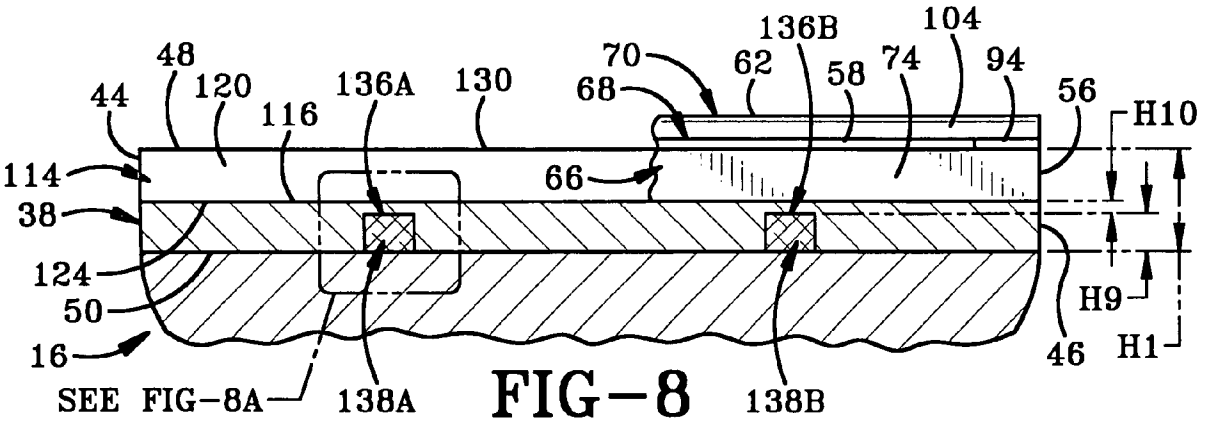
FIG. 8 is a sectional view taken on line 8-8 of FIG. 6.
Figure 9:
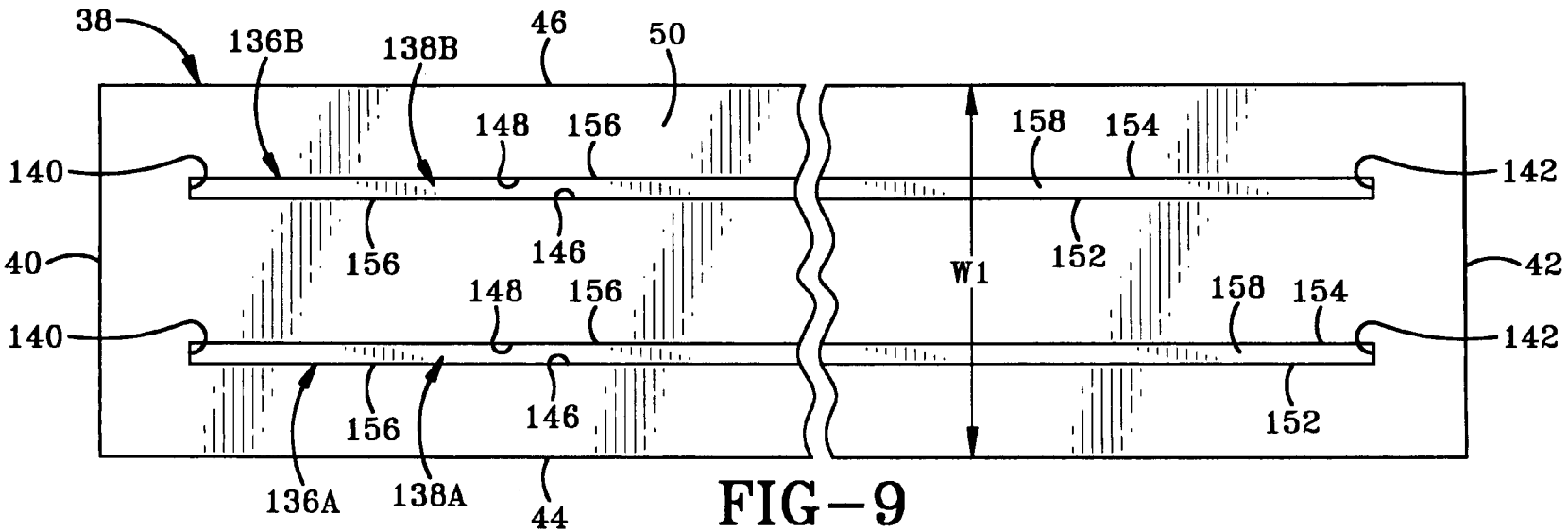
FIG. 9 is a bottom plan view of the fingerboard.

Referring to FIGS. 8-9, the structure of fret board 38 is described in greater detail. A pair of slots 136A and 136B are formed in fret board 38 which extend upwardly from lower surface 50 and from adjacent first end 40 to second end 42. A pair of reinforcing rods 138A and 138B are respectively received within slots 136A and B. Slots 136 thus are elongated in the longitudinal direction of fret board 38 and axially spaced from one another, as are rods 138. Each rod has first and second ends 140 and 142 which are respectively spaced inwardly longitudinally from respective ends 40 and 42 of fret board 38, typically about an inch or so. Each slot has a top 144 and first and second sides 146 and 148 all of which extend from first end 140 to second end 142. In the exemplary embodiment, sides 146 and 148 are parallel to one another and perpendicular to top 144 and thus define a rectangular cross section of slot 136. Rods 138 extend substantially the full length of the respective slot 136 and have a rectangular cross section (the shape of which may vary) which forms a mating engagement with top 144 and sides 146 and 148. More particularly, each rod has a top 150 which abuts top 144, a first side 152 which abuts first side 146 and a second side 154 which abuts second side 148 of the respective slots 136.

Rods 138 may be formed of metal but in the exemplary embodiment they are formed of a carbon fiber material which has a relatively high tensile strength and is light in weight. Rods 136 are typically secured within slots 136 with glue 156 and in particular an epoxy glue which is highly suited to form a strong bond with carbon fiber material and wood. Sides 146 and 148 define therebetween a width W10 (FIG. 8A) of each slot 136. Sides 152 and 154 of each rod 138 defines therebetween a width W11 which is slightly smaller than with W10 and is typically on the order of about 0.125 to 0.188 inch (⅛ to 3/16 inch) although width W11 may be greater. Each rod also has a bottom 158 typically parallel to top 150 so that top 150 and bottom 158 define therebetween a height H9 which is typically on the order of about 0.094 to 0.188 inch (3/32 to 3/16 inch). The height of each slot 136 defined between top 144 and lower surface 50 is nearly the same as height H9 or slightly greater. Bottom 158 of each rod 138 is typically either flush with lower surface 50 or recessed and thus higher than surface 50 in order to provide a flat surface to fret board 38 for securing to the upper surface of neck 16, typically by glue. Top 144 of each slot 136 and bottom 116 of each groove 114 define therebetween a height H10 which is typically on the order of about 0.031 to 0.063 inch (1/32 to 1/16 inch) although this may vary.

The use of reinforcing rods 138 is particularly helpful in light of the substantial increase in the height or depths of grooves 114 which are often ⅛ to 3/16 inch while maintaining the standard thickness or height H1 of fret board 38 which as previously noted is typically on the order of about ¼ to 5/16 inch. Thus, in the exemplary embodiment, each groove 114 has a height or depth which is approximately ½ that of height H1 of fret board 38. Rods 138 provide additional strength to fret board 38 and thus facilitate the ability to handle the fret board once grooves 114 have been cut therein and prior to securing fret board 38 to neck 16. In addition, it is believed that reinforcing rods 138 may also facilitate improved resonance or other sound characteristics during the play of the stringed instrument. It is noted that while in the exemplary embodiment each of the frets 52 installed on fret board 38 are substantially identical to one another aside from length differences associated with a tapered neck and fret board, one or more of frets 52 may have other dimensions which are different from frets 52 on the same fret board. As one example, the plates 68 of frets 52 nearest nut 32 (FIG. 1) may be wider than frets 52 as one moves toward bridge 30. In addition, the tangs and associated grooves 114 may also vary in dimension at different locations along fret board 38.

Fret and fret assembly 200 is now described with reference to FIG. 10. Assembly 200 is shown in use with an acoustic guitar 202 which has a hollow body or sound box 204 and includes various other parts which are numbered similar to those of the electric guitar 12. Thus, guitar 202 includes a neck 16, a head 18, tuning pegs 20, strings 22, first and second ends 24 and 26 defining a longitudinal direction of guitar 202, a string mounting block 28, a bridge 30 and a nut 32. Assembly 200 includes a fret board 204 which is similar to fret board 38 and a plurality of frets 206 which are similar to frets 52.

Figures 11, 12:
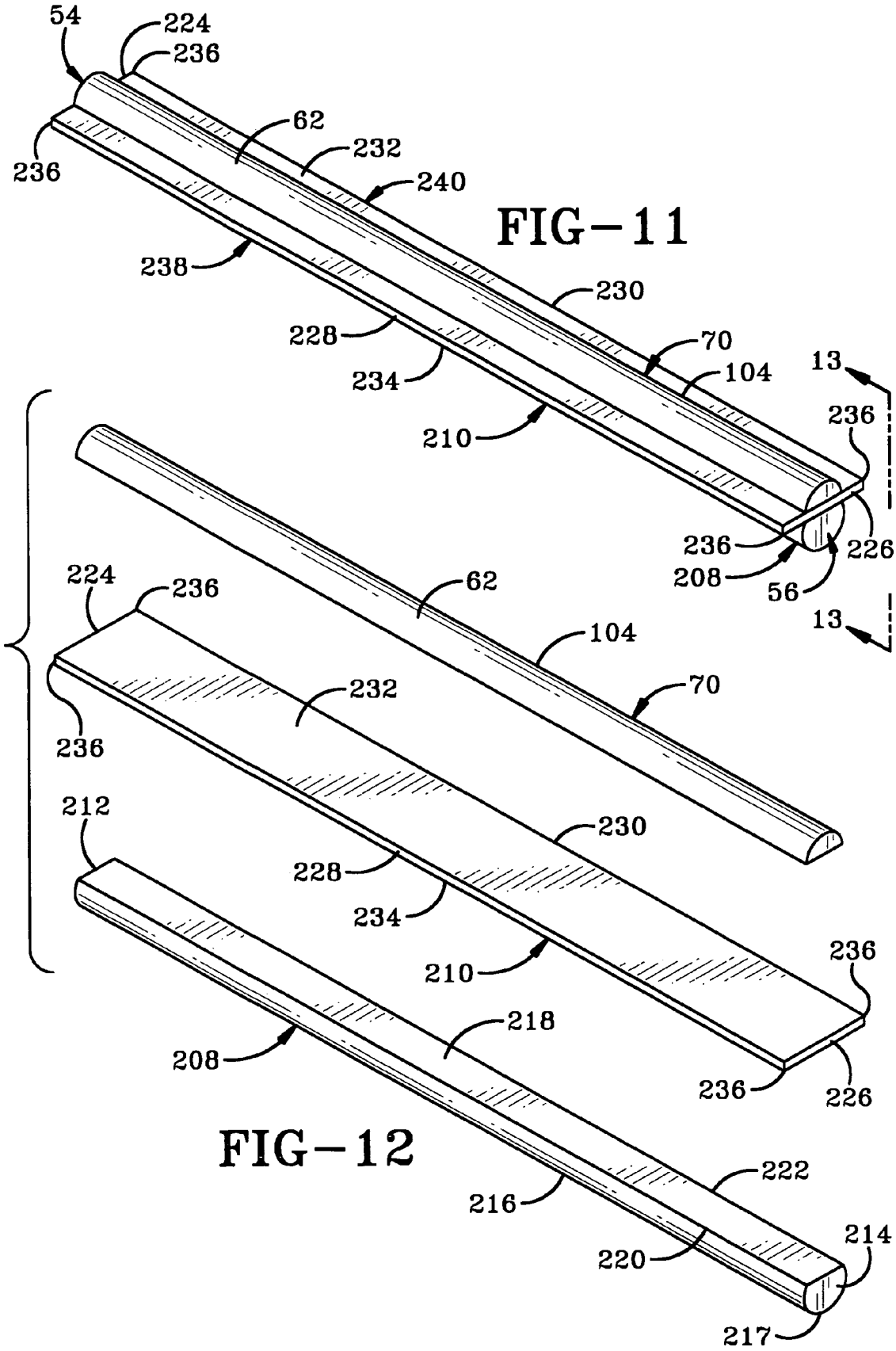
FIG. 11 is an enlarged perspective view of the second embodiment of the fret.
FIG. 12 is an enlarged exploded perspective view of the second embodiment of the fret.

Referring to FIGS. 11 and 12, fret 206 is described in greater detail. Each fret 206 includes a cap 70 which was described in the previous embodiment and may include a cap with alternate top 112 as shown with fret 52 in FIG. 4. Each fret 206 further includes a tang 208 which has a truncated circular cross section and a plate 210 which is similar to plate 68 except that it does not have beveled corners such as corners 94 and thus has a rectangular configuration as viewed from above. Tang 208 has first and second ends 212 and 214 defining therebetween its length which is the same as the length of fret 206 defined between ends 54 and 56. Similar to tang 66 of the first embodiment, the outer perimeter 216 of tang 208 is smooth and preferably continuous from end to end so that tang 208 has a constant cross section from first end 212 to second end 214 to facilitate its lengthwise sliding installation into and removal from its respective groove in the same manner as discussed with the previous embodiment. Tang 208 is a truncated cylinder and has a circular outer perimeter or surface 216 which is greater than a semicircle, but which is truncated by a flat horizontal top 218 which meets or intersects perimeter 216 at respective first and second corners or intersections 220 and 222. Plate 210 has first and second ends 224 and 226 which are coincident with ends 54 and 56 respectively. Plate 210 also has first and second sides or edges 228 and 230 which are parallel to one another and extend between and are perpendicular to ends 224 and 226. Sides 228 and 230 meet edges 224 and 226 at respective right angle corners 236 and thus plate 210 has a flat horizontal rectangular top 232 and a flat horizontal rectangular bottom 234.

Figure 13:
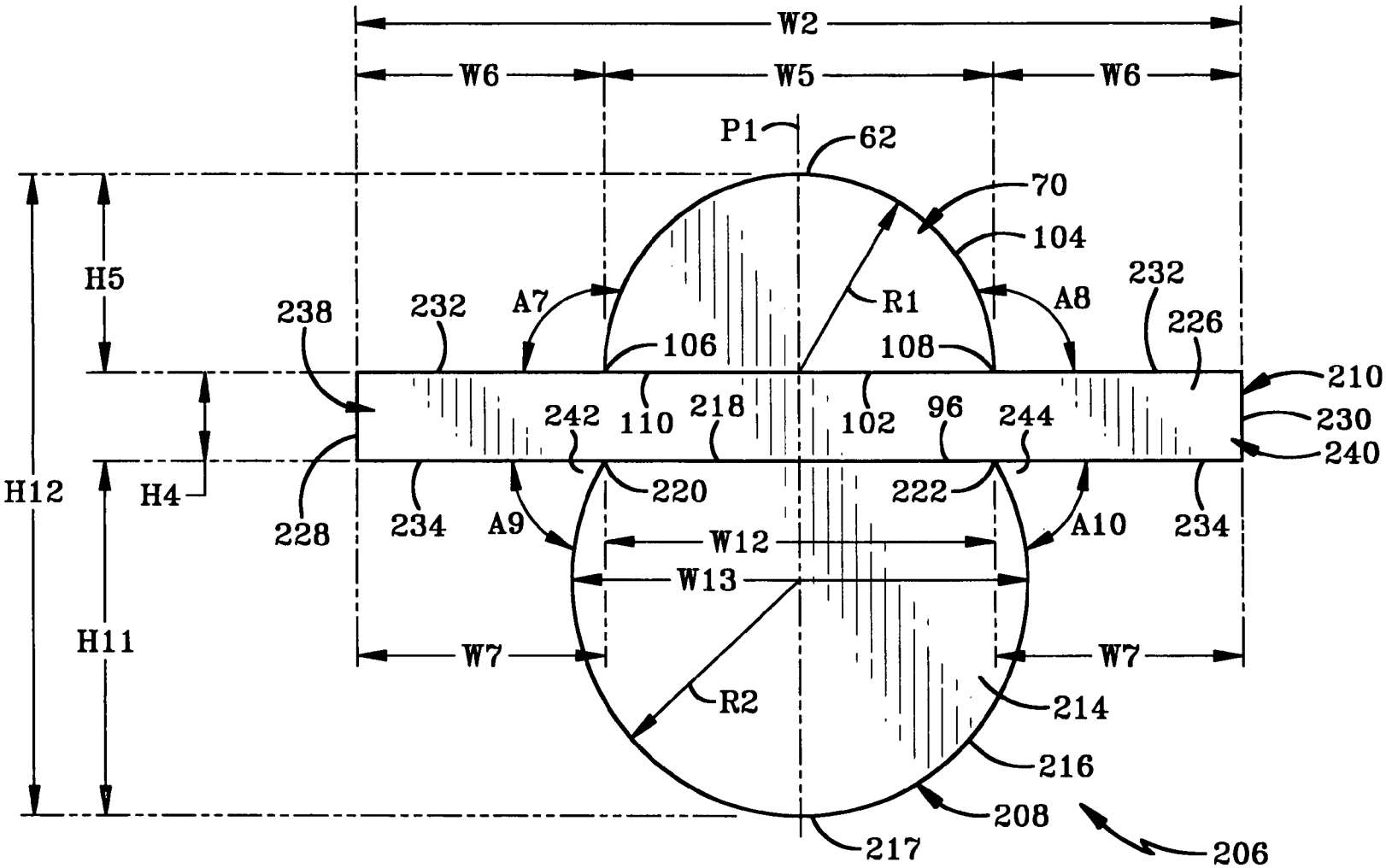
FIG. 13 is an enlarged end elevational view taken on line 13-13 of FIG. 11.

As shown in FIG. 13, cap 70 is secured to top 232 of plate 210 with solder 110 as described with respect to the first embodiment. Numerals 106 and 108 in FIG. 13 refer to the edge and corners as previously discussed and also refer to the intersections between semicircular surface 104 and top 230 of the respective wings 238 and 240. In addition, top 218 is permanently or non-removably secured to bottom 234 of plate 210 with solder 96 as previously described. Plate 210 thus forms first and second wings 238 and 240 which respectively extend laterally outwardly from corners 220 and 222 in opposite directions from one another respectively a distance or width W7 (perpendicular to the length of fret 206) to respective terminal ends 228 and 230. Numerals 220 and 222 also refer to the intersections between outer perimeter or surface 216 and bottoms 234 of the respective wings 238 and 240. Bottom 234 of first wing 238 and outer perimeter 216 adjacent corner 220 define therebetween an angle A9. Likewise, bottom 234 of second wing 240 and outer perimeter 216 adjacent corner 222 define therebetween an angle A10 which is acute and equal to angle A9 since outer perimeter 216 is greater than a semicircle and preferably substantially greater. Thus, the arc of perimeter 216 adjacent corner 220 angles downwardly and outwardly away from plane P1 and the center of fret 206. Likewise, an arc of perimeter 216 adjacent corner 222 angles downwardly and outwardly away from central plane P1 and away from corner 220. This configuration forms spaces 242 and 244 adjacent corners 220 and 222 between bottom 234 and outer perimeter 216 and directly above respective portions of tang 208.

Corner 220 and corner 222 define therebetween a width W12 at top 218 of tang 208 which in the exemplary embodiment is substantially the same as width W5 and thus approximately 0.11 inch. Width W12 may be more or less than width W5 and typically falls within the range of about 0.08 to 0.20 inch. Perimeter 216 lies on a circle having a radius R2 which is greater than radius R1 and thus defines a maximum width W13 which is the diameter of the circle and in the exemplary embodiment is approximately 0.125 inch (⅛ inch). Width W13 may be up to about ¼ inch when used with fret boards having height H1. Width W13 is thus greater than width W12 and width W5 so that tang 208 extends outwardly laterally in opposite directions respectively beyond edge 106 and edge 108 of cap 70. Bottom 217 and top 218 of tang 208 define therebetween a height H11 of tang 208 which in the exemplary embodiment is typically about 0.10 to 0.125 inch. Height H11 more generally falls within the same ranges as those given for height H3. Top 62 and bottom 217 define therebetween a height H12 which typically falls within the same ranges as height H2.

The total cross sectional area of fret 206 taken perpendicular to its length in the exemplary embodiment is about 0.021 square inch and typically ranges from about 0.014 to 0.082 square inch. The analogous cross sectional area of tang 208 in the exemplary embodiment is about 0.01 square inch and typically ranges from about 0.009 to 0.042 square inch. Perimeter 216 of tang 208 along this cross section in the exemplary embodiment is about 0.258 inch and typically within the range of about 0.2 to 0.555 inch.

Figure 14:
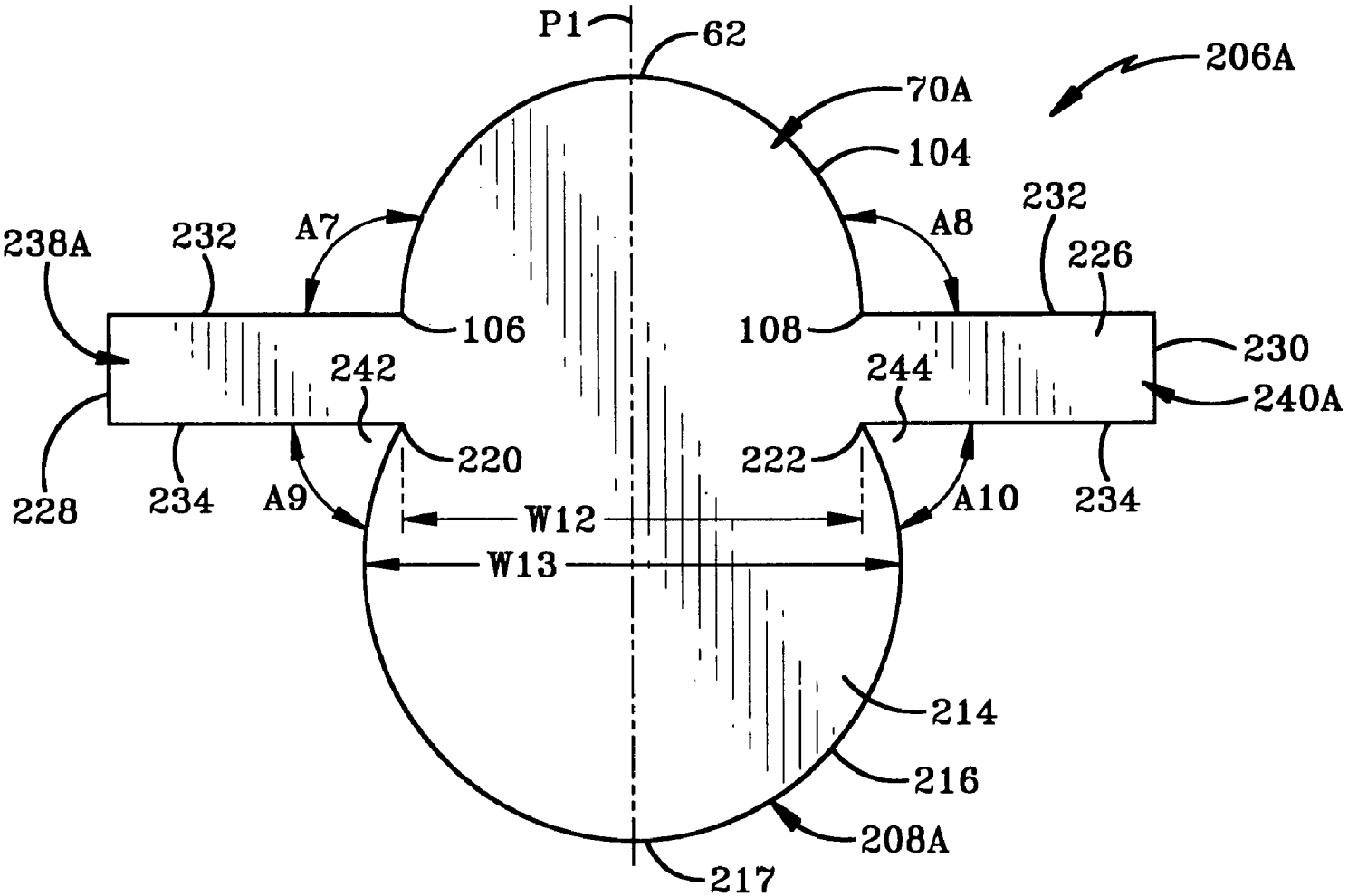
FIG. 14 is an end elevational view similar to FIG. 13 showing an alternate configuration of the second embodiment of the fret.

Referring to FIG. 14, an alternate embodiment of fret 206 is shown at 206A and like fret 52A, and has the same overall configuration as fret 206 except that it is formed from a single piece of rigid material which is most typically a metal as discussed above. Thus, all of the dimensions of fret 206A are the same as fret 206. Fret 206A may be formed by extrusion or any other suitable method. Thus, fret 206A is free of the solder joints or connections such as those between the components of fret 206. In addition, fret 206A includes no plate such as plate 210 although wings 238A and 240A extend outwardly in the same manner as wings 238 and 240 and have the same configuration and dimensions.

Figure 15:
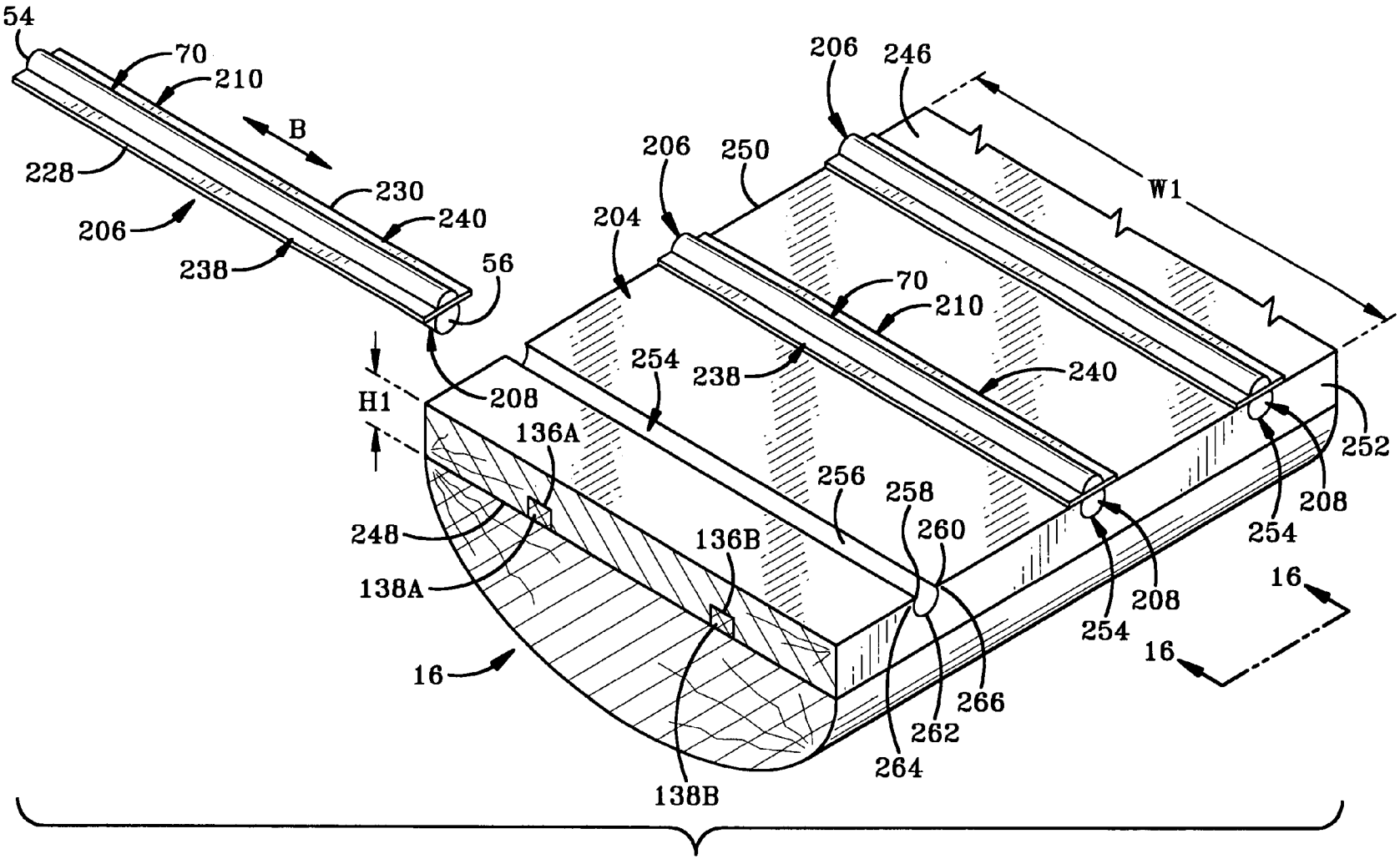
FIG. 15 is a perspective view of the assembly of the second embodiment with portions cut away and portions of the fret board shown in section and secured to the neck of the acoustic guitar with one of the frets of the second embodiment removed from its groove.

Referring to FIG. 15, it is noted that fret board 204 has the same overall dimensions of fret board 38. Thus, fret board 204 has upper and lower surfaces 246 and 248 defining therebetween height H1. Fret board 204 also has first and second sides or edges 250 and 252 defining therebetween width W1. Slots 136 are formed in fret board 204 in the same manner as in fret board 38 and receive reinforcing rods 138 in the same manner. A plurality of parallel grooves 254 are formed in fret board 204 and extend perpendicular to the longitudinal direction of fret board 204. Each groove 254 is generally of a circular configuration which is truncated by upper surface 246. Thus, each groove 254 is bounded by a truncated circular surface 256 which is truncated by its intersection with upper surface 246 at edges or corners 258 and 260. Surface 256 has a bottom 262. Because surface 256 is greater than a semicircle, portions of fret board 204 adjacent corners 258 and 260 form overhangs 264 and 266 each of which overhangs a portion of groove 254. Each groove 254 thus has substantially the same cross sectional dimension as tang 208 except for being slightly larger and typically within the previously noted tolerance range.

Figure 16:
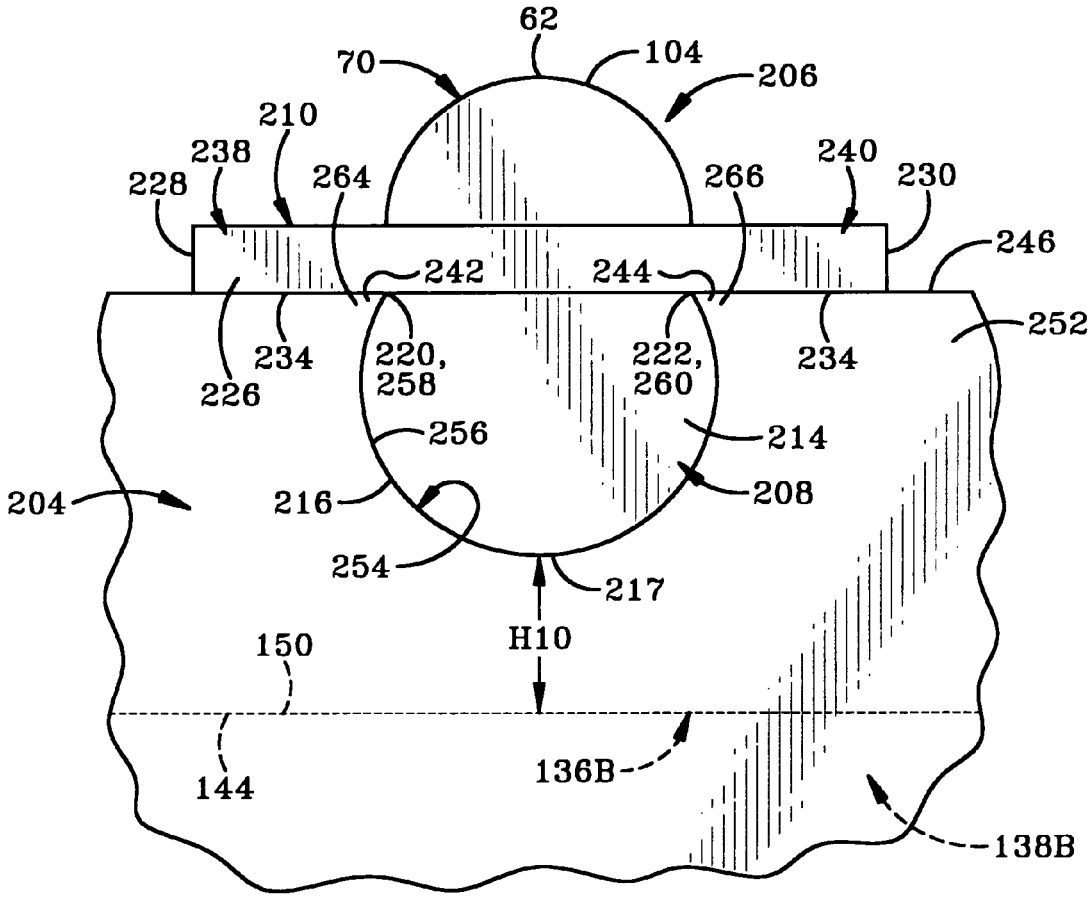
FIG. 16 is an enlarged end elevational view of the fret of the second embodiment taken on line 16-16 of FIG. 15.

Thus, as shown in FIG. 15 at Arrow B, tang 208 is slidably receivable lengthwise into and out of groove 254 with outer perimeter 216 of tang 208 substantially in continuous contact with circular perimeter or surface 256 bounding groove 254 along the entire length of the respective fret and groove. Perimeter 256 is thus substantially the same as perimeter 216 aside from the small tolerance difference and thus falls substantially within the perimeter ranges given for perimeter 216. Likewise, the cross sectional area of groove 254 is substantially the same as the area of tang 208 and falls within the same ranges given for the area of tang 208 above. As shown in FIG. 16, overhangs 264 and 266 are respectively received within spaces 242 and 244 to provide an interference as in the first embodiment of the fret and groove which prevents tang 208 from being removed upwardly from groove 254. In addition, bottom 234 of wing 238 provides a substantially continuous contact with upper surface 246 of fret board 204 from first side 250 to second side 252 and from corners 220 and 258 outwardly to terminal end 228. Likewise, bottom 234 of second wing 240 maintains a similar continuous contact with upper surface 246 all the way across fret board 204 and from corners 222 and 260 outwardly to terminal end 230. Thus, the total distance representing the continuous contact between fret 206 and fret board 204 as measured along a cross section perpendicular to the length of fret 206 and equal to the cross sectional outer perimeter 216 plus two times width W7, which equates to the width or distance that each bottom 234 of wings 238 and 240 extends outwardly from respective corners 220 and 222 to their respective terminal ends. This total distance is in the exemplary embodiment about 0.4 inch and typically ranges from about 0.25 to 1.02 inch, and more particularly represents the perimeter 216 plus two times width W7.

Unlike tang 66 of fret 52, the circular configuration of tang 208 does not create an interference to rotational movement of tang 208 within groove 254 about a longitudinal axis at the center of the circle defined by outer perimeter 216 although the fairly tight frictional engagement helps reduce such rotational movement. However, the engagement between bottoms 234 of wings 238 and 240 and upper surface 246 of fret board 204 does provide an interference to prevent such rotational movement and thus provides substantially greater stability to fret 206 than may be achieved by certain prior art frets which are simply circular rods with a portion extending above the upper surface of the fret board. Overhangs 264 and 266 of fret board 204 are not as substantial as overhangs 128 and 132 of fret board 38, but nonetheless prevent the upward removal of tang 208 from groove 254 without the use of glue, screws or other fasteners. In addition, the generally circular structure of fret 208 does not provide as great a mass or cross sectional surface area as does the dovetail configuration of tang 66 where each of the tangs has the same height. However, the configuration of tang 208 nonetheless provides a substantial increase to the size of the tang compared to a conventional tang. Test results showing the improvement of fret 206 over prior art frets is provided further below.

Fret and fret board assembly 300 is shown in FIG. 17. Assembly 300 includes a fret board 302 having the same overall dimensions of fret boards 38 and 204 and a plurality of frets 304 (only one shown) arranged on fret board 302 in the same general manner as frets 52 and 206 along their respective fret boards. Fret board 302 has an upper surface 303. Fret 304 is similar to the previous frets in that it includes a cap 70 and a plate 68 or 210 having a first wing 98 or 238 and a second wing 100 or 240. Fret 304 differs from the previous embodiments in having a tang 306 which has a square cross sectional configuration which is constant from the first end of the fret to the second end of the fret and thus extends along the entire width of fret board 302. Tang 306 thus has first and second parallel sides 308 and 310, and a parallel bottom 312 and top 314 perpendicular to sides 308 and 310. Tang 306 thus has an outer perimeter in the cross sectional direction which extends along the entire length of sides 308 and 310 and bottom 312 and is thus equal to two times height H3 plus width W3. When fret 304 is made in separate components, top 314 is soldered to bottom 234 of plate 68, 210. As with the previous embodiments, all of the components may be formed as a single piece such as by extrusion or the like. As shown in FIG. 17, sides 308 and 310 define therebetween a width indicated at W3 and thus having the same dimensions as previously described with width W3 in FIG. 4. Likewise, bottom 312 and top 314 define therebetween height H3 having the same dimensions as previously discussed. Vertical sides 308 and 310 are perpendicular to bottoms 234 of their respective wings and intersect their respective wings at corners 313 and 315.

A plurality of grooves 316 (only one shown) is formed in fret board 302 extending downwardly from upper surface 303 and generally in the same manner as noted with the previous embodiments. Each groove 316 has a square cross sectional configuration and thus has a flat horizontal bottom 318 and first and second parallel vertical sides 320 and 322 extending upwardly from bottom 318 to intersect upper surface 303 at respective corners 324 and 326 at right angles. The square corners 324 and 326 thus meet or are closely adjacent corners 313 and 315 respectively when tang 306 is received in groove 316. When tang 306 is installed within groove 316, bottom 312 and sides 308 and 310 of tang 306 are in substantially continuous contact respectively with bottom 318 and sides 320 and 322 along the entire length of the fret and groove. Groove 316 is thus formed with a width and height which are respectively only slightly larger than width W3 and height H3 in accordance with the previously noted tolerances. Thus, tang 306 fits very snugly within groove 316. The cross sectional area of groove 316 is thus only slightly larger than that of tang 306 and thus falls within the same ranges given above for tang 206. In addition, the perimeter of groove 316 is defined by bottom 318 and first and second sides 320 and 322 is only slightly larger than that of the outer perimeter of tang 206 described above and thus falls within about the same ranges. The total contact area between fret 306 and fret board 302 thus includes the contact to interface between tang 306 and fret board 302 within groove 316 as well as the contact between bottom surfaces 88, 234 of wings 238 and 240.

The total cross sectional area of fret 304 taken perpendicular to its length in the exemplary embodiment is about 0.025 square inch and typically falls within the range of 0.01 to 0.09 square inch. The analogous cross sectional area of tang 306 (height H3 times width W3) in the exemplary embodiment is about 0.014 square inch and typically ranges from about 0.005 to 0.048 square inch. The perimeter of tang 306, which equals width W3 plus two times height H3 is in the exemplary embodiment about 0.36 inch and typically ranges from about 0.2 to 0.65 inch. The total distance of continuous contact with fret board 302 along the perpendicular cross section equals this exposed outer perimeter of tang 306 plus two times width W7, which is in the exemplary embodiment about 0.5 inch and typically ranges from about 0.25 to 0.9 inch.

Unlike the previous embodiments, the configuration of tang 306 and groove 316 does not provide overhangs which provide interference to the upward removal of tang 306 from groove 316. Thus, tang 306 would typically be glued to fret board within groove 316 to secure fret 304 to the fret board 302. Nonetheless, the wings 98, 238, 100, 240 still provide additional stability to fret 304 to help prevent movement of tang 306 within groove 316. As with the previous embodiments, bottom 234 of wing 98, 238 is in substantial continuous contact across the entire width of fret board 302 from corners 313 and 324 laterally outwardly to terminal end 58, 228. Likewise, bottom 88, 234 of wing 100, 240 is in substantial continuous contact all the way across fret board 302 from corners 315 and 326 to terminal edge 60, 230. As shown in FIG. 17, each of the wings has a width W7 along which this continuous interface is provided. In addition, the mass and cross sectional area of tang 306 is substantial. As shown in FIG. 17, width W3 of tang 306 is approximately equal to and preferably at least as great as width W5 of cap 70. In addition, the substantial height and width of tang 306 and groove 316 provides a substantially larger perimeter or surface area of contact between tang 306 and the surfaces bounding groove 316 which substantially increases the surface area of contact between tang 206 and fret board 302 for securing tang 306 within groove 316 to provide a more secure grip and better stability of fret 304.

As shown in FIG. 17, fret board utilizes reinforcement rods 138 within respective grooves 136 in the same manner as the previous embodiments. Grooves 316 and tang 306 extend downwardly from upper surface 303 to about the same degree as the grooves and tangs of the previous embodiments so that the distance between the bottom of the tang and groove and the top of slot 136 and rod 138 is also represented at height H10.

Two different tests were performed to determine the improvement of the frets of the present invention with respect to standard frets. In the first test, the sound pressure level was first measured on every fretted note of a 6-string Ibanez 550 electric guitar with the standard frets which came with the guitar, and subsequently on the same guitar after replacing the standard frets with frets 206 and fret board 204 of the present invention. For the purposes of testing, the strings were tuned in accordance with the standard tuning arrangement in which the first string (high string) was tuned to a high E, the second string was tuned to B, the third string was tuned to G, the fourth string was tuned to D, the fifth string was tuned to A and the sixth string was tuned to a low E. The Ibanez 550 guitar includes twenty-four frets against which the strings may by pressed to provide sequential half step changes in pitch as well known in the art. Thus, a guitarist is able to play twenty-four fretted notes for each of the strings and consequently 144 total fretted notes. For the purpose of the test, the guitar was connected to a Roland Cube 30 electric guitar amplifier having a speaker to amplify the sound. A Goldline 30m8 SPL decibel meter utilizing an anechoic microphone was placed 36 inches from the speaker to ascertain the sound pressure level of each of the notes. For each of the 144 fretted notes played with standard frets, the corresponding notes played with frets 206 and the associated fret board of the present invention installed on the guitar showed an increase of 3 to 4 decibels for each note. An increase in 3 decibels is about a 40% increase in loudness. It is further noted that an analogous test was performed without amplification and with the microphone six inches from the guitar strings with the same results, namely a 3 to 4 decibel increase for each fretted note played with frets 206 compared to the corresponding notes played with the standard frets.

A second test was performed to make a comparison of the sustain or duration of various notes.

TABLE 1

| | Standard Frets Duration (seconds) | Present Frets Duration (seconds) | Difference Increase (seconds) |
|---|---|---|---|
| Single Notes | | | |
| C | 14 | 17 | 3 |
| A | 14 | 17 | 3 |
| G | 8 | 17 | 9 |
| E | 11 | 17 | 6 |
| D | 11 | 17 | 6 |
| B | 11 | 17 | 6 |
| Chords | | | |
| C Major | 19 | 22 | 3 |
| A Major | 18 | 25 | 7 |
| G Major | 16 | 19 | 3 |
| E Major | 22 | 25 | 3 |
| D Major | 14 | 22 | 8 |

Table 1 indicates a comparative test of guitars using stand frets and fret 206 of the present invention. More particularly, an Ibanez RG series electric guitar with frets 206 and the associated fret board installed thereon was used to obtain the results as shown in the column with the heading "Present Frets" in Table 1. The results in the "Standard Frets" column were obtained with the use of an S101 electric guitar, which is a copy of the Ibanez RG series guitar except utilizing standard frets. The Roland Cube 30 electric guitar amplifier was used to amplify each of the guitars during the test. The Goidline 30m8 SPL decibel meter utilizing an anechoic microphone was used to track the decibel level over time of the notes played. The meter, microphone and each guitar was positioned 36 inches away from the front or "speaker side" of the amplifier during the respective test. All volumes and calibrations of the meter were set at 100 decibels. Only the bridge pickup of each guitar was used during the test, each bridge pickup having a 16 ohm impedance. All notes, whether single or in chord form, were plucked or strummed by hand by Jason Rivera, a professional guitarist and guitar instructor with over 40 years experience as a guitarist. Each note and chord was plucked or strummed with the same amount of energy to provide an accurate comparison between the two guitars and the frets thereof. To minimize error in variations in the amount of energy applied during plucking or strumming, each note and chord was played 10 to 15 times and an average was taken to produce the results in Table 1. The duration of each note or chord was measured from the time of attack (that is, essentially the moment of playing the note or chord) to the time at which the note or chord decreased down to −70 decibels as measured by the decibel meter.

The two guitars used in the test producing the results in Table 1 were tuned in the same fashion as noted above in the first test. Given this tuning arrangement, the specific single notes and chords played during the test are now explained. Beginning with the single notes starting at the top of Table 1 and going down the results, the C note was played on the first fret of the second string; the A note was played on the second fret of the third string; the G note on the third fret of the sixth string; the E note on the second fret of the fourth string; the D note on the third fret of the second string; and the B note on the second fret of the fifth string. All of the chords played for the test used the standard "open chord" fingering. Thus, the C major chord was played with the fingering as follows—open first string, first fret of the second string, open third string, second fret of the fourth string, and third fret of the fifth string, with only these five strings being strummed. The A major chord was played with an open first string, second fret of the second string, second fret of the third string, second fret of the fourth string, open fifth string and open sixth string. The G major chord was played with the third fret of the first string, open second string, open third string, open fourth string, second fret of the fifth string and third fret of the sixth string. The E major chord was played with open first string, open second string, first fret of the third string, second fret of fourth string, second fret of the fifth string and open sixth string. The D major chord was played with the second fret of the first string, the third fret of the second string, the second fret of the third string, open fourth string and open fifth string, with only these five strings being played.

As shown by the results of Table 1, each note or chord utilizing the frets of the present invention have an average duration from 3 to 9 seconds longer than the corresponding note or chord using the standard frets under the given conditions. Surprisingly, not only did the single notes show an increase in duration, but the open chord configuration also showed such an increase. This is surprising inasmuch as it would be expected that the open strings played on the various chords on either guitar would tend to have a duration longer than any fretted notes. However, the test disproved this expectation, apparently indicating that even the fretted notes with the frets of the present invention have a greater duration than the open notes of the comparison guitar. As with the first test discussed above, it was noted during the second test that the single notes and chords played with the frets of the present invention showed an increase of 3 decibels or more compared to the corresponding notes and chords played on the comparison guitar.

In light of the relatively wide ranges of dimensions given for each fret, and to prevent an exhaustive list of measurements falling within these cited ranges, Applicant hereby reserves the right to claim these various dimensions at various intervals such as tenths, hundredths, thousandths, thirty-seconds, sixteenths, eighths, and so forth. Applicant further reserves the right to claim the ratios between the various distances, perimeters, areas, and any other measurements which may be calculated utilizing the incremental measurements within the ranges given.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A fret for a stringed instrument comprising:

a cap having a string-engageable top and a bottom;

a tang having a top and a bottom and adapted to fit within a groove in a fret board;

a first wing having a top permanently secured to the bottom of the cap and a bottom permanently secured to the top of the tang; the first wing extending laterally outward from the bottom of the cap and the top of the tang in a first direction to a first terminal edge; and a second wing having a top permanently secured to the bottom of the cap and a bottom permanently secured to the top of the tang; the second wing extending laterally outward from the bottom of the cap and the top of the tang in a second direction opposite the first direction to a second terminal edge; the bottoms of the first and second wings adapted to abut an upwardly facing surface of the fret board when the tang is in the groove.

2. The fret of claim 1 further comprising first and second ends on the fret defining therebetween a longitudinal direction of the fret; and wherein the tang has a cross sectional area perpendicular to the longitudinal direction of the fret which is at least 0.005 square inch.

3. The fret of claim 2 wherein the cross sectional area of the tang perpendicular to the longitudinal direction of the fret is at least 0.01 square inch.

4. The fret of claim 3 wherein the cross sectional area of the tang perpendicular to the longitudinal direction of the fret is at least 0.02 square inch.

5. The fret of claim 2 wherein the tang has an outer perimeter measured along a cross section perpendicular to the longitudinal direction of the fret; the bottom of the first wing intersects the top of the tang at a first intersection; the bottom of the second wing intersects the top of the tang at a second intersection; the first intersection and the first terminal end define therebetween along the perpendicular cross section a first width; the second intersection and the second terminal end define therebetween along the perpendicular cross section a second width; and the total distance of the outer perimeter, the first width and the second width is at least 0.25 inch.

6. The fret of claim 5 wherein the total distance is at least 0.35 inch.

7. The fret of claim 1 wherein the top of each wing is horizontal.

8. The fret of claim 1 wherein the top and bottom of the first wing are parallel to one another; and the top and bottom of the second wing are parallel to one another.

9. The fret of claim 8 wherein the first and second terminal edges define therebetween a horizontal width which is at least 5/32 inch.

10. The fret of claim 9 further comprising a first connection between the top of the first wing and the bottom of the cap; a second connection between the bottom of the first wing and the top of the tang; a third connection between the top of the second wing and the bottom of the cap; and a fourth connection between the bottom of the second wing and the top of the tang; and wherein the top and bottom of the first wing define therebetween a constant height in the range of 0.020 to 0.060 inch from one of the first and second connections to the first terminal end; and the top and bottom of the second wing define therebetween a constant height in the range of 0.020 to 0.060 inch from one of the third and fourth connections to the second terminal end.

11. The fret of claim 1 further comprising first and second ends on the fret defining therebetween a longitudinal direction of the fret; and wherein the first and second terminal edges define therebetween a first horizontal width perpendicular to the longitudinal direction of the fret which is at least 5/32 inch.

12. The fret of claim 11 wherein the first horizontal width is at least 3/16 inch.

13. The fret of claim 11 wherein the tang has a second horizontal width perpendicular to the longitudinal direction of the fret which is at least 5/32 inch.

14. The fret of claim 1 further comprising first and second ends on the fret defining therebetween a longitudinal direction of the fret; first and second edges on the cap defining therebetween a horizontal maximum width of the cap perpendicular to the longitudinal direction of the fret; and wherein the bottoms of the first and second wings extend respectively outwardly beyond the first and second edges of the cap a first distance which is at least 1/6 the maximum width of the cap.

15. The fret of claim 14 wherein the first and second terminal edges of the wings define therebetween a horizontal width perpendicular to the longitudinal direction of the fret which is at least 3/16 inch.

16. The fret of claim 14 wherein the first distance is at least 1/3 the maximum width of the cap.

17. The fret of claim 1 further comprising first and second ends on the fret defining therebetween a longitudinal direction of the fret; first and second edges on the cap defining therebetween a maximum horizontal width of the cap perpendicular to the longitudinal direction of the fret; and a first horizontal tang width of the tang at its top perpendicular to the longitudinal direction of the fret which is at least 3/4 the maximum width of the cap.

18. The fret of claim 17 further comprising a second horizontal tang width of the tang perpendicular to the longitudinal direction of the fret at a height which is below the top of the tang and which is greater than the first tang width whereby the tang is adapted to form an interference with the fret board when within the groove to prevent removal of the tang from within the groove in an upward direction.

19. The fret of claim 1 further comprising first and second edges on the cap defining therebetween a maximum width of the cap; and first and second portions of the tang which extend respectively in the first and second directions outwardly beyond the first and second edges of the cap by at least 0.03 inch.

20. The fret of claim 1 in combination with the fret board; and further comprising first and second ends on the fret board defining therebetween a longitudinal direction of the fret board; a groove which is formed in the fret board transverse to its longitudinal direction and in which the tang is received; at least one slot elongated in the longitudinal direction of the fret board; and at least one reinforcing rod elongated in the longitudinal direction of the fret board and secured to the fret board within the at least one slot.

* * * * *